US011647832B2

(12) United States Patent
Sheikhi et al.

(10) Patent No.: US 11,647,832 B2
(45) Date of Patent: May 16, 2023

(54) CABINET ASSEMBLY

(71) Applicant: NewAge Products Inc., Toronto (CA)

(72) Inventors: Asad Sheikhi, Barrie (CA); Robert Vandenham, Woodbridge (CA)

(73) Assignee: NewAge Products Inc., Toronto (CA)

( * ) Notice: Subject to any disclaimer, the term of this patent is extended or adjusted under 35 U.S.C. 154(b) by 37 days.

(21) Appl. No.: 17/176,400

(22) Filed: Feb. 16, 2021

(65) Prior Publication Data

US 2022/0257007 A1 Aug. 18, 2022

(51) Int. Cl.
*A47B 47/00* (2006.01)
*A47B 45/00* (2006.01)

(52) U.S. Cl.
CPC ..... *A47B 47/0008* (2013.01); *A47B 45/00* (2013.01); *A47B 47/0083* (2013.01); *A47B 2230/0081* (2013.01); *A47B 2230/02* (2013.01)

(58) Field of Classification Search
CPC . A47B 47/0008; A47B 47/0083; A47B 47/03; A47B 47/05; A47B 45/00; A47B 2230/0081; A47B 2230/02
USPC ..... 312/257.1, 107, 108, 204, 265.5
See application file for complete search history.

(56) References Cited

U.S. PATENT DOCUMENTS 2,686,704 A * 8/1954 Wolters ..... A47B 47/03 312/257.1
2,837,393 A 6/1958 Sitler
3,040,848 A * 6/1962 Powell ..... A47B 47/03 108/108
3,087,768 A * 4/1963 Mack ..... A47B 47/0008 403/217
3,178,246 A 4/1965 Hendrik
3,305,255 A * 2/1967 Henderson ..... F16B 12/50 403/219
3,403,641 A 10/1968 Baker
(Continued)

FOREIGN PATENT DOCUMENTS

FR 2958521 A1 10/2011
WO 2020005946 A1 1/2020
(Continued)

OTHER PUBLICATIONS

Design U.S. Appl. No. 29/695,966.
(Continued)

*Primary Examiner* — Daniel J Troy
*Assistant Examiner* — Timothy M Ayres
(74) *Attorney, Agent, or Firm* — Howard & Howard Attorneys PLLC

(57) ABSTRACT

A cabinet assembly including a first frame having a first open channel, a second frame spaced from the first frame with the second frame having a second open channel, and a plurality of beams extending between the first and second frames and interlocking to each of the first and second frames. Each of the beams include a bottom side, a top side opposite the bottom side, and a pair of opposing recessed portions extending from the top and bottom sides. Each of the recessed portions has an upper surface and a lower surface with the upper surface being disposed below the top side. A portion of the bottom side and the entire recessed portion is disposed within the first open channel. The top side is disposed outside the first open channel to interlock the beam to the first and second frames.

23 Claims, 15 Drawing Sheets

(56) References Cited

U.S. PATENT DOCUMENTS

| | | | | |
|---|---|---|---|---|
| 3,746,417 | A | 7/1973 | Sasnett | |
| 3,773,399 | A | 11/1973 | Sulcek | |
| 3,837,721 | A | 9/1974 | Manlove et al. | |
| 3,961,456 | A | 6/1976 | Manlove et al. | |
| 4,045,104 | A * | 8/1977 | Peterson | A47B 47/03 312/263 |
| 4,378,137 | A * | 3/1983 | Gibson | A47B 47/03 312/265.3 |
| 4,464,074 | A * | 8/1984 | Green | E04B 1/2403 403/255 |
| 4,691,644 | A * | 9/1987 | Frydman | A47B 47/03 312/265.5 |
| 4,886,045 | A | 12/1989 | Ducate, Jr. et al. | |
| 5,176,435 | A * | 1/1993 | Pipkens | A47B 17/00 312/265.6 |
| 5,419,628 | A | 5/1995 | Myslinski, Jr. et al. | |
| 5,466,062 | A * | 11/1995 | McPherson | A47B 95/02 16/415 |
| 5,496,105 | A * | 3/1996 | Czarnecky | A47B 88/43 312/265.5 |
| 5,513,759 | A * | 5/1996 | Besserer | F16M 1/00 312/265.2 |
| 5,713,651 | A * | 2/1998 | Essig | F16B 12/50 403/219 |
| 5,803,561 | A * | 9/1998 | Puehlhorn | A47B 47/04 312/265.5 |
| 5,899,036 | A | 5/1999 | Seiber et al. | |
| 5,921,647 | A * | 7/1999 | Schneider | A47B 87/008 211/187 |
| 6,007,170 | A * | 12/1999 | Liebertz | A47B 88/941 312/265.5 |
| 6,019,446 | A * | 2/2000 | Laboch | H02B 1/308 312/265.2 |
| 6,053,585 | A | 4/2000 | Osen | |
| 6,099,095 | A * | 8/2000 | Irace | A47B 47/02 312/265.5 |
| 6,152,553 | A * | 11/2000 | Wunderlich | F16B 12/02 312/265.2 |
| 6,425,219 | B1 | 7/2002 | Barmak et al. | |
| D475,552 | S | 6/2003 | Thompson | |
| 6,619,600 | B1 | 9/2003 | Johnson et al. | |
| 6,652,206 | B2 | 11/2003 | Heflin et al. | |
| 6,843,025 | B2 | 1/2005 | Paz | |
| 7,055,287 | B2 | 6/2006 | Yu et al. | |
| 7,055,878 | B2 | 6/2006 | Imhof | |
| 7,497,531 | B2 | 3/2009 | Gross | |
| 3,511,293 | A1 | 8/2013 | Thompson et al. | |
| 9,596,948 | B1 | 3/2017 | McGinnis | |
| 9,661,922 | B2 | 5/2017 | Ehmke et al. | |
| 10,327,541 | B2 | 6/2019 | Insinna | |
| 10,689,018 | B2 | 6/2020 | Patton et al. | |
| 10,702,099 | B2 | 7/2020 | O'Shaughnessy et al. | |
| 10,760,299 | B2 | 9/2020 | Preston | |
| 10,772,466 | B2 | 9/2020 | O'Shaughnessy et al. | |
| 11,083,283 | B1 * | 8/2021 | Shyu | A47B 13/003 |
| 2004/0065313 | A1 | 4/2004 | Thompson | |
| 2005/0133018 | A1 | 6/2005 | Spangrud | |
| 2006/0061242 | A1 | 3/2006 | Chang | |
| 2007/0108878 | A1 * | 5/2007 | Chen | A47B 47/0091 312/107 |
| 2007/0170136 | A1 | 7/2007 | Kenny | |
| 2007/0246035 | A1 * | 10/2007 | Chen | A47J 37/0704 126/41 R |
| 2008/0067900 | A1 | 3/2008 | Marshall et al. | |
| 2010/0079045 | A1 | 4/2010 | Yeh | |
| 2010/0148641 | A1 | 6/2010 | Ehmke | |
| 2011/0068668 | A1 * | 3/2011 | Wilson | A47B 47/0083 312/265.5 |
| 2011/0115350 | A1 | 5/2011 | Tsai et al. | |
| 2011/0260592 | A1 | 10/2011 | Lin et al. | |
| 2012/0153782 | A1 | 6/2012 | Fraser | |
| 2013/0113343 | A1 | 5/2013 | Singlak et al. | |
| 2013/0312732 | A1 | 11/2013 | Brennan | |
| 2018/0073290 | A1 | 3/2018 | Jeffries et al. | |
| 2019/0072122 | A1 | 3/2019 | DeSmet et al. | |
| 2019/0145699 | A1 | 5/2019 | Mellits et al. | |
| 2019/0277075 | A1 | 9/2019 | Jeffries | |
| 2020/0000277 | A1 | 1/2020 | O'Shaughnessy et al. | |
| 2020/0000278 | A1 | 1/2020 | O'Shaughnessy et al. | |
| 2020/0000279 | A1 | 1/2020 | O'Shaughnessy et al. | |
| 2020/0000280 | A1 | 1/2020 | O'Shaughnessy et al. | |
| 2020/0000281 | A1 | 1/2020 | O'Shaughnessy et al. | |
| 2020/0000283 | A1 | 1/2020 | O'Shaughnessy et al. | |

FOREIGN PATENT DOCUMENTS

| | | | |
|---|---|---|---|
| WO | 2020005969 | A1 | 1/2020 |
| WO | 2020005972 | A1 | 1/2020 |
| WO | 2020005976 | A1 | 1/2020 |
| WO | 2020005978 | A1 | 1/2020 |
| WO | 2020005981 | A1 | 1/2020 |

OTHER PUBLICATIONS

Design U.S. Appl. No. 29/695,973.
Design U.S. Appl. No. 29/695,976.
Design U.S. Appl. No. 29/695,969.

* cited by examiner

CABINET ASSEMBLY

FIELD OF THE INVENTION

The present disclosure relates generally to a cabinet assembly including a decorative panel and an interlocking mechanism.

DESCRIPTION OF THE RELATED ART

Cabinet assemblies known in the art generally include back panel, side panels, and front panels coupled to a top and bottom. However, standard cabinet assemblies offer few options addressing the aesthetic options for panels. Conventional offerings do not allow for accommodation of decorative finishes or components. Alternate panels must typically be custom fabricated and do not offer the ability for modifications in appearance or aesthetic following installation.

Further, configurations of cabinet assemblies are assembled with threaded fasteners or similar. Fasteners simplify the design of the cabinet and may be replaced by a user. In order to assemble the cabinet, a tool such as a screwdriver, wrench, or drill may be necessary to tighten the threaded fasteners. In other configurations, cabinets that can be assembled or disassembled with minimal tools or without the use of tools are also available in the art. To accomplish this, a cabinet is assembled by interlocking certain panels. While cabinet assemblies known in the prior art may have utilized interlocking panels, there remains a need in the art for an improved cabinet assembly that is less expensive to manufacture and easier to assemble.

Accordingly, improvements in existing cabinet assemblies are needed to provide interchangeable, customizable decorative panels and interlocking mechanisms that are easy to assemble the cabinet.

SUMMARY OF THE INVENTION

The invention includes a cabinet assembly including a first frame having a first open channel, a second frame spaced from the first frame with the second frame having a second open channel, and a plurality of beams extending between the first and second frames and interlocking to each of the first and second frames within the first and second open channels to connect the first frame to the second frame. Each of the plurality of beams comprises a bottom side, a top side opposite the bottom side, and a pair of opposing recessed portions extending from the top and bottom sides. Each of the recessed portions has an upper surface and a lower surface with the upper surface being disposed below the top side. A portion of the bottom side and the entire recessed portion is disposed within the first open channel. The top side is disposed outside the first open channel to interlock the beam to the first and second frames.

The invention also includes a cabinet assembly including a first side frame and an opposing second side frame and a bottom panel coupled to the first frame and second frame. The cabinet assembly further includes a plurality of beams extending between the first side frame and the second side frame and interlocking to each of the first and second side frames to connect the first side frame to the second side frame and to define an interior volume of the cabinet assembly. The cabinet assembly further includes a plurality of support brackets defining at least one track, a mounting mechanism including a first portion on at least of one of the plurality of beams and a second portion on at least of one of the plurality support brackets to mount the support bracket to the beam, and a plurality of wall panels with each wall panel slidably engaged within the tracks of an opposing pair of the support brackets for defining a side of the cabinet assembly.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF INVENTION

Figure 1:
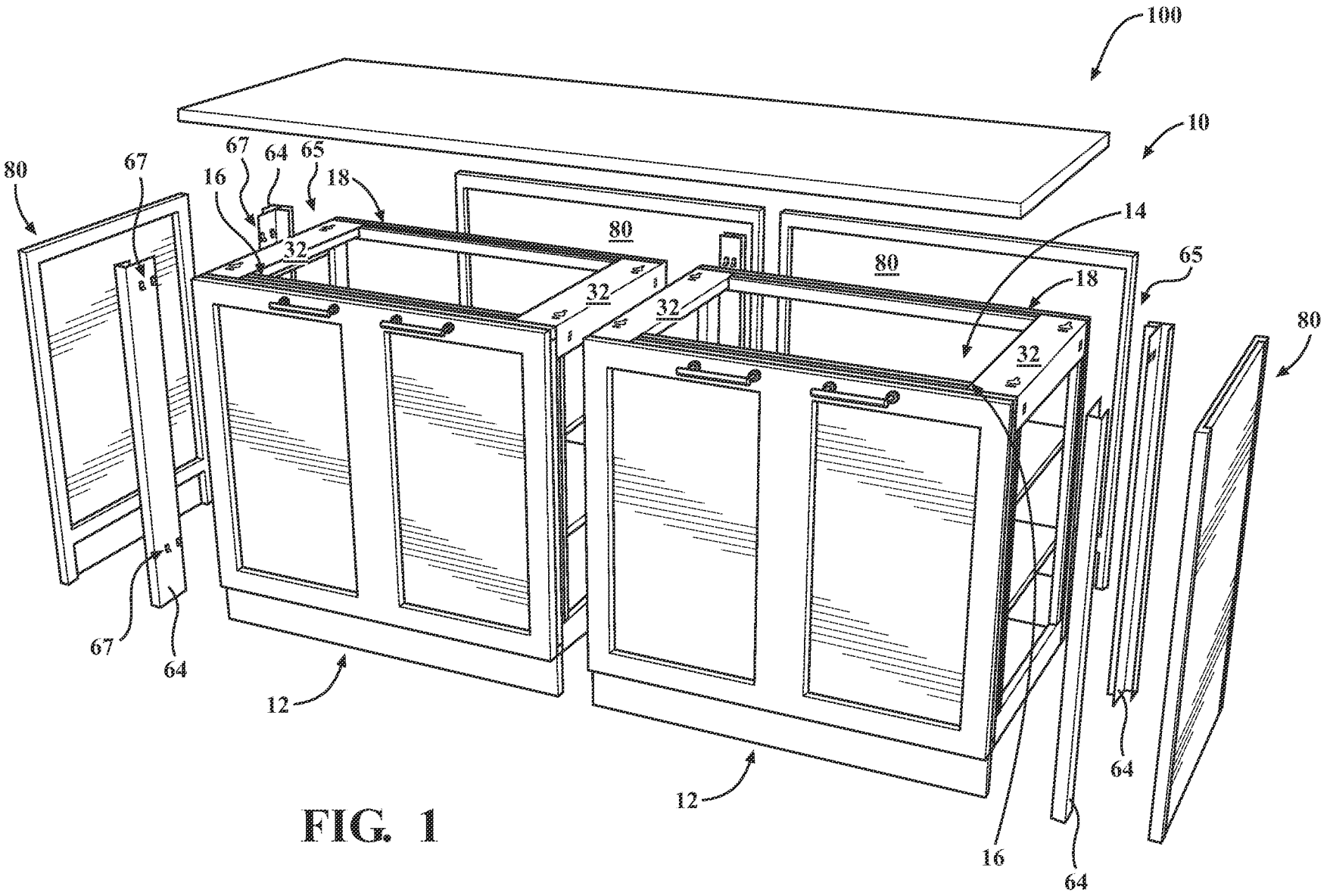
FIG. 1 is an exploded view illustrating a cabinet system including two cabinet assemblies, according to one configuration.
Figure 2:
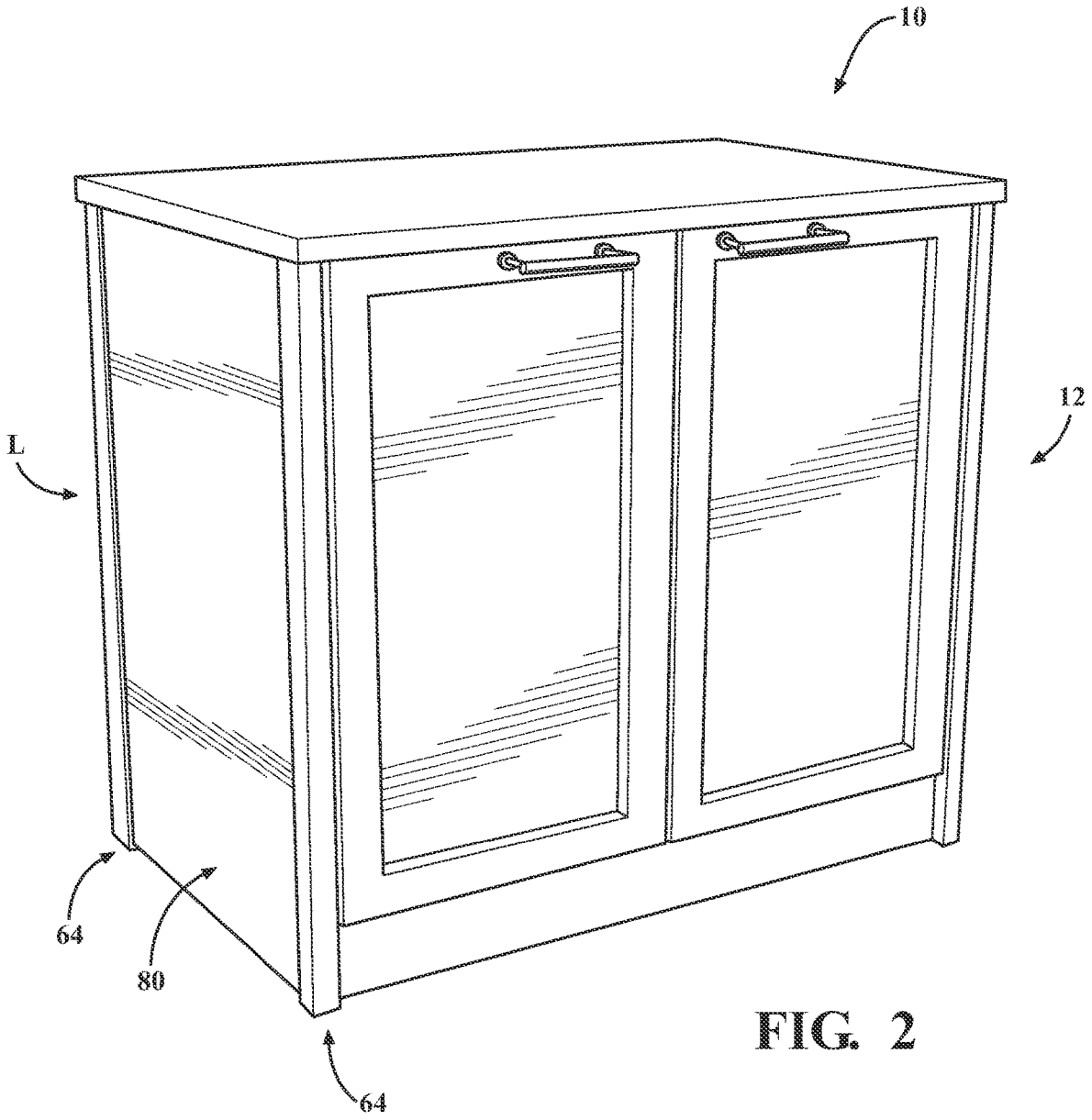
FIG. 2 is a perspective view of a cabinet system including a cabinet assembly, according to another configuration.

Referring to the Figures, wherein like numerals indicate like or corresponding parts throughout the several views, configurations of a cabinet system 100 including a cabinet assembly 10 are shown throughout the figures and described in detail below. As shown in FIG. 1, generally, the cabinet assembly 10 may be modified and/or adapted to be attached to another cabinet assembly. In some configurations, the cabinet assembly 10 may not be considered a standalone structure, as shown in FIG. 1, while in some configurations, the cabinet assembly 10 may be a standalone structure, as shown in FIG. 2. The cabinet system 100 may be any type of cabinet configuration and/or combination of cabinet configurations. For example, the cabinet system 100 may be a door cabinet, side cabinet, grill cabinet, kamado cabinet, kitchen cabinet, corner cabinet, and the like. It is contemplated that the cabinet system 100 may include any number of cabinet assemblies 10.

Although in the configurations shown throughout the Figures and described below, the cabinet system 100 has a double-door configuration, it is contemplated that the cabinet system 100 may include any number of doors.

Figure 3:
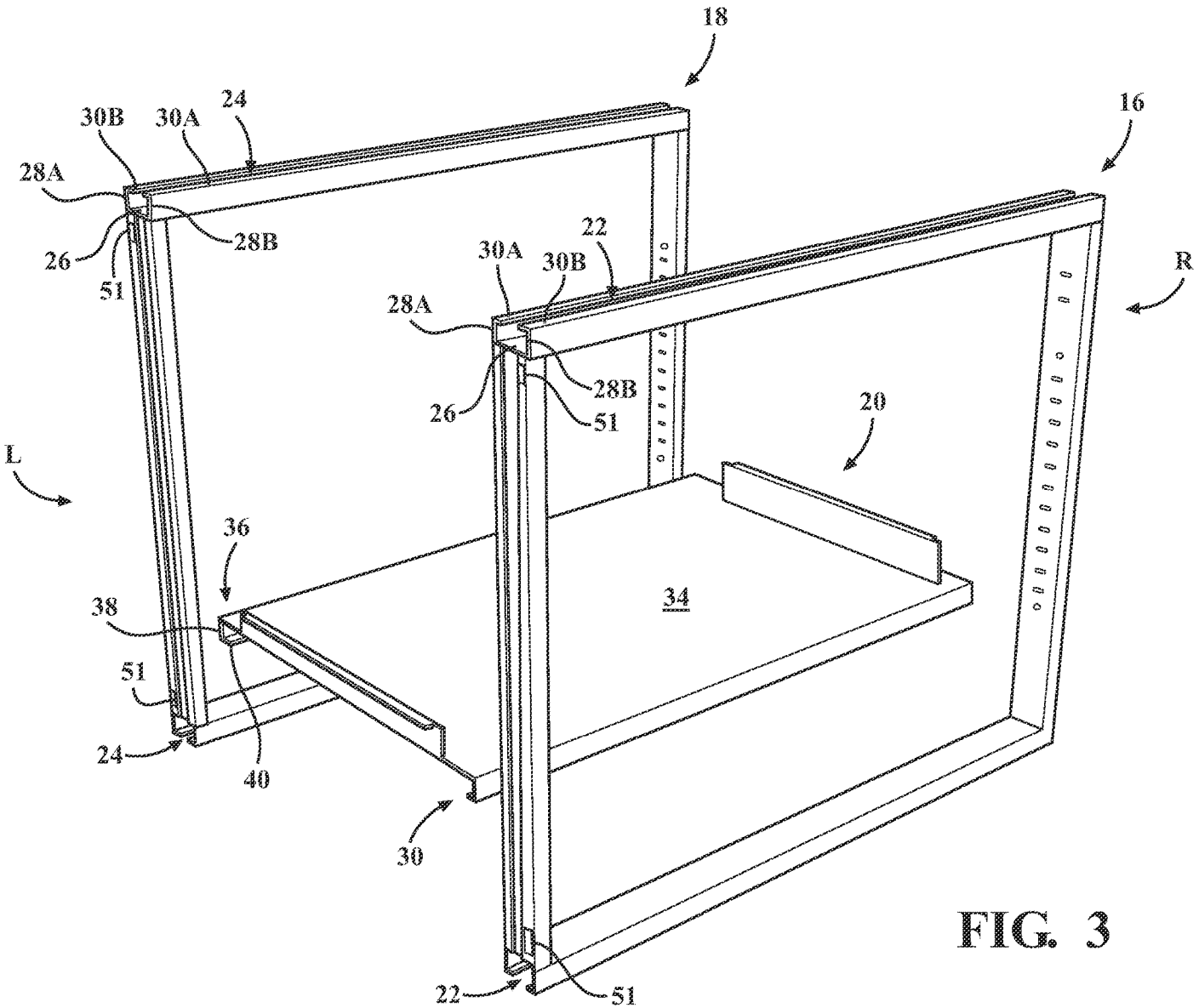
FIG. 3 is an exploded view of a first frame, a second frame, and an exterior panel of the cabinet assembly of FIG. 2.

Details of the cabinet assembly 10 will be described. The cabinet assembly 10 is configured such that an end user or consumer may easily construct the cabinet assembly 10. As shown in FIGS. 1-3, generally, the cabinet assembly 10 includes a cabinet body 12. For illustrative and descriptive means, as shown in FIG. 2, from a front perspective view of the cabinet assembly 10, the cabinet body 12 includes a left side L and a right side R. In configurations with more than one cabinet assembly 10 or cabinet body 12, the cabinet assembly 10 or cabinet body 12 may include a continuous interior volume 14 between each cabinet assembly 10 or cabinet body 12. In some configurations, the cabinet assembly 10 may additionally include any number of shelves or drawers disposed within the interior volume 14 and coupled to the cabinet body 12.

Figure 4:
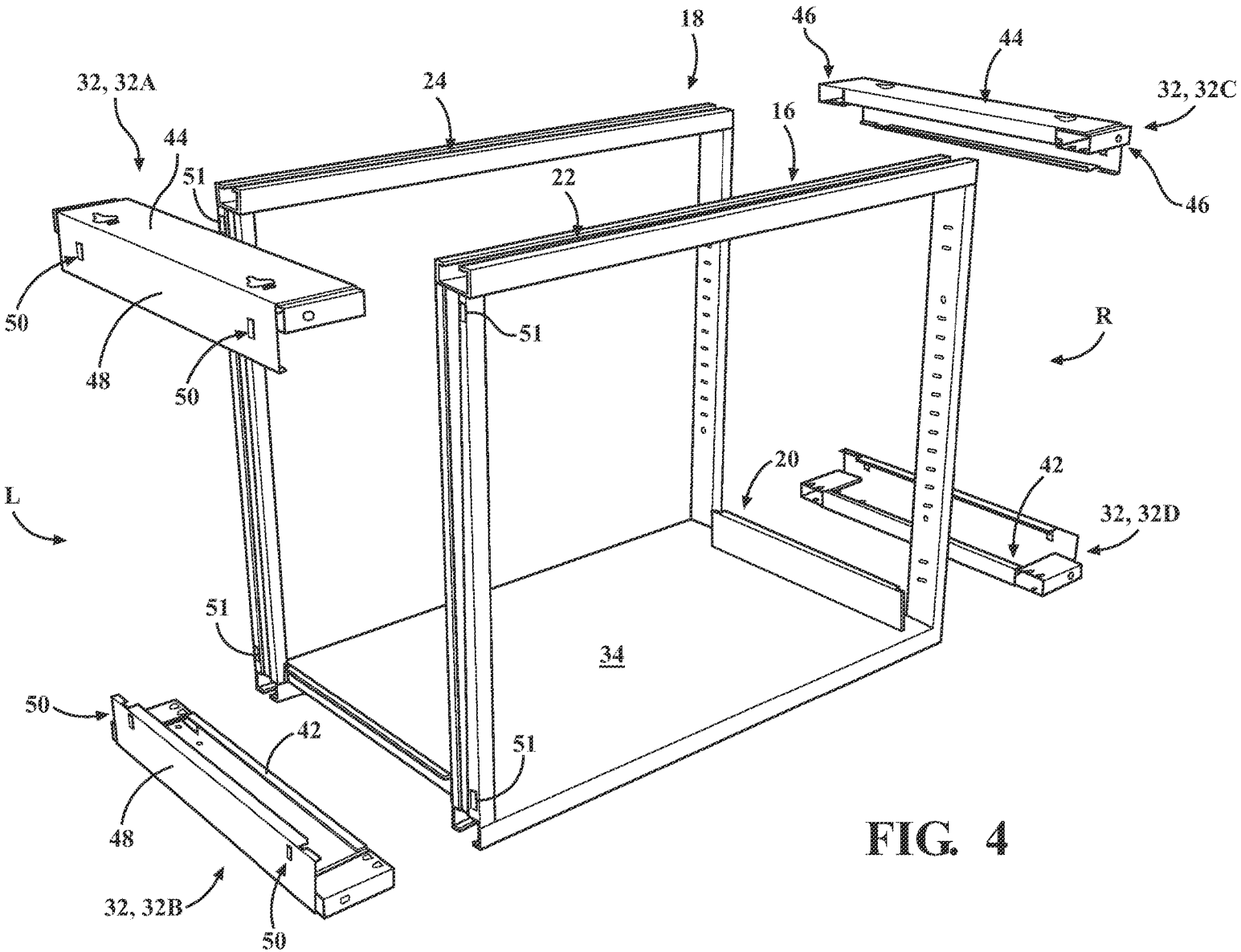
FIG. 4 is a partially exploded, perspective view of the cabinet assembly of FIG. 2 including the first frame, the second frame, and the exterior panel including a plurality of beams.

Referring to FIGS. 3 and 4, the cabinet body 12 that includes a first frame 16 and a second frame 18 spaced from the first frame 16. The cabinet body 12 may include at least one exterior panel 20 coupled to at least one of the first frame 16 and second frame 18. The first frame 16 includes a first open channel 22 and the second frame 18 includes a second open channel 24. The first and second open channels 22, 24 are configured to receive a beam 32 extending between the first and second frames 16, 18. It is contemplated that the first and second frames 16, 18 may include any number of open channels. In the configurations shown, the first frame 16 includes two open channels 22 and the second frame 18 includes two open channels 24. The first and second open channels 22, 24 are defined along the top and bottom sides of the first and second frames 16, 18, respectively. It is further contemplated that the open channel(s) may be defined along any side of the first and second frames 16, 18. For example, the first frame 16 and the second frame 18 may each include an open channel on the left side L. Each of the first and second frames 16, 18 include a lower surface 26, a pair of side surfaces 28A, 28B, and a pair of upper surfaces 30A, 30B, shown in FIGS. 3 and 8. At least a portion of the pair of upper surfaces 30A, 30B define a top opening to partially define the first and second open channels 22, 24. Further, the lower surface 26, pair of side surfaces 28A, 28B, and pair of upper surfaces 30A, 30B are spaced to define at least one side opening to partially define the first and second open channels 22, 24.

Referring to FIG. 3, the exterior panel 20 may include a top surface 34 and an attachment portion 36 extending from the top surface 34. The attachment portion 36 is configured to couple to the first and second frames 16, 18. The attachment portion 36 is shaped to fit or connect around a portion of the first and second frames 16, 18. The attachment portion 36 includes a first portion 38 extending downwards from the top surface 34 and a second portion 40 extending parallel to the top surface 34. In the configuration shown, the attachment portion 36 is L-shaped. In other configurations, the attachment portion 36 may be any shape. For example, the attachment portion 36 may be a U-shape with a first portion 38 extending downwards from the top surface 34, a second portion 40 extending parallel to the top surface 34, and a third portion 72 extending towards the top surface 34. In another example, the attachment portion 36 may be a tab with a portion extending from the top surface 34. It is understood that the exterior panel 20 may couple to at least one of the first and second frames 16, 18 in any suitable manner. For example, the exterior panel 20 may be fitted to the first and second frames 16, 18. In another example, the exterior panel 20 may be snap-fitted to the first and second frames 16, 18. It yet another example, the exterior panel 20 may mounted to the first and second frames 16, 18.

The exterior panel 20 may be any type of panel that couples to at least one of the first frame 16 and the second frame 18. In the configurations shown, the exterior panel 20 is a bottom panel. It is contemplated that the exterior panel 20 may be a side panel, front panel, back panel, and/or door panel. It is further contemplated that the cabinet assembly 10 may include any number of exterior panels.

In some configurations, the cabinet assembly 10 may further include any number of interior panels. In such configurations, the interior panel may include an attachment portion similar to the exterior panel 20.

Referring now to FIG. 4, the cabinet assembly 10 further includes a plurality of beams 32 extending between the first frame 16 and the second frame. The plurality of beams 32 interlock to each of the first and second frames 16, 18 to connect the first frame 16 to the second frame. Once interlocked, the first frame 16, the second frame, the exterior panel 20, and the plurality of beams 32 define an interior volume 14 of the cabinet assembly 10.

As shown, the cabinet assembly 10 includes 4 beams, denoted as 32A, 32B, 32C, and 32D. The plurality of beams 32 is further defined as two left side beams 32A, 32B being mounted to a left side of the first and second frames 16, 18 and two right side beams 32C, 32D being mounted to a right side of the first and second frames 16, 18. The two left side beams 32A, 32B may be mounted to the left side L of the cabinet body 12 and the two right side beams 32C, 32D may be mounted to the right side R of the cabinet body 12. In other configurations, the plurality of beams 32 may be further defined to include any number of beams. For example, the cabinet assembly 10 may include two beams with one beam defined as a left side beam being mounted to a left side of the first and second frames 16, 18 and the second beam being mounted to a right side of the first and second frames 16, 18. In yet another example, where the one or more cabinet assemblies are attached, the cabinet assembly 10 may include one beam defined as a left side beam being mounted to a left side of the first and second frame. In this example, the right side of the first and second frame may couple to a side of another cabinet assembly 10. In yet another example, where one or more cabinet assemblies are attached, the cabinet assembly 10 may include two beams defined as two right side beams being mounted to a right side of the first and second frame.

Each beam 32A, 32B, 32C, 32D, includes a bottom side 42, a top side 44 opposite the bottom side 42, and a pair of opposing recessed portions 46A, 46B extending from the top and bottom sides 44, 42. It will be appreciated that the plurality of beams 32 may be referred to as beam 32 collectively and apply to each beam 32A, 32B, 32C, 32D, and so on, unless otherwise stated.

Figure 5A:
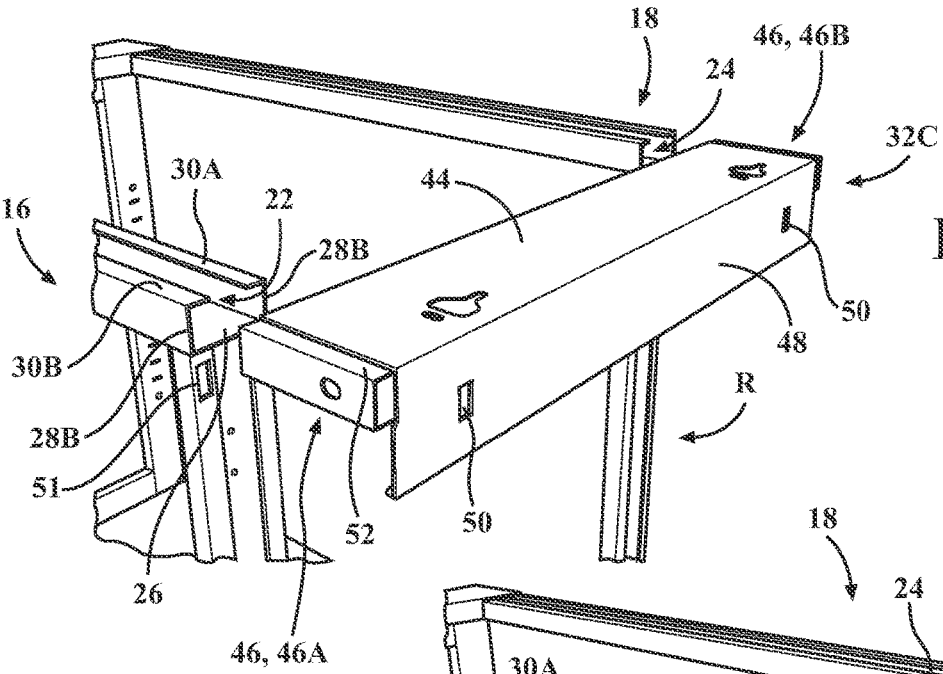
FIGS. 5A-5C are schematic views of an interlocking mechanism of the cabinet assembly, according to one configuration.
Figure 5B:
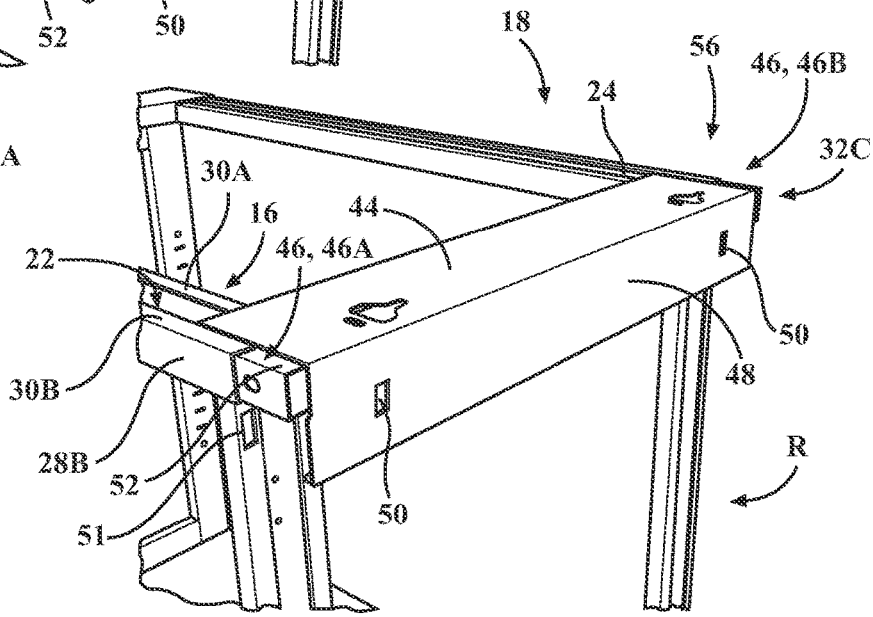
Figure 5C:
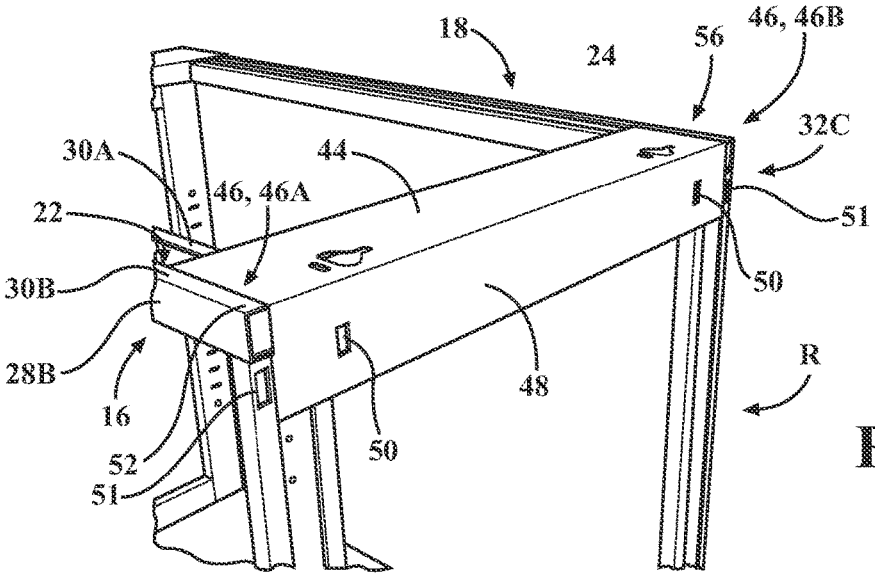
Figure 6:
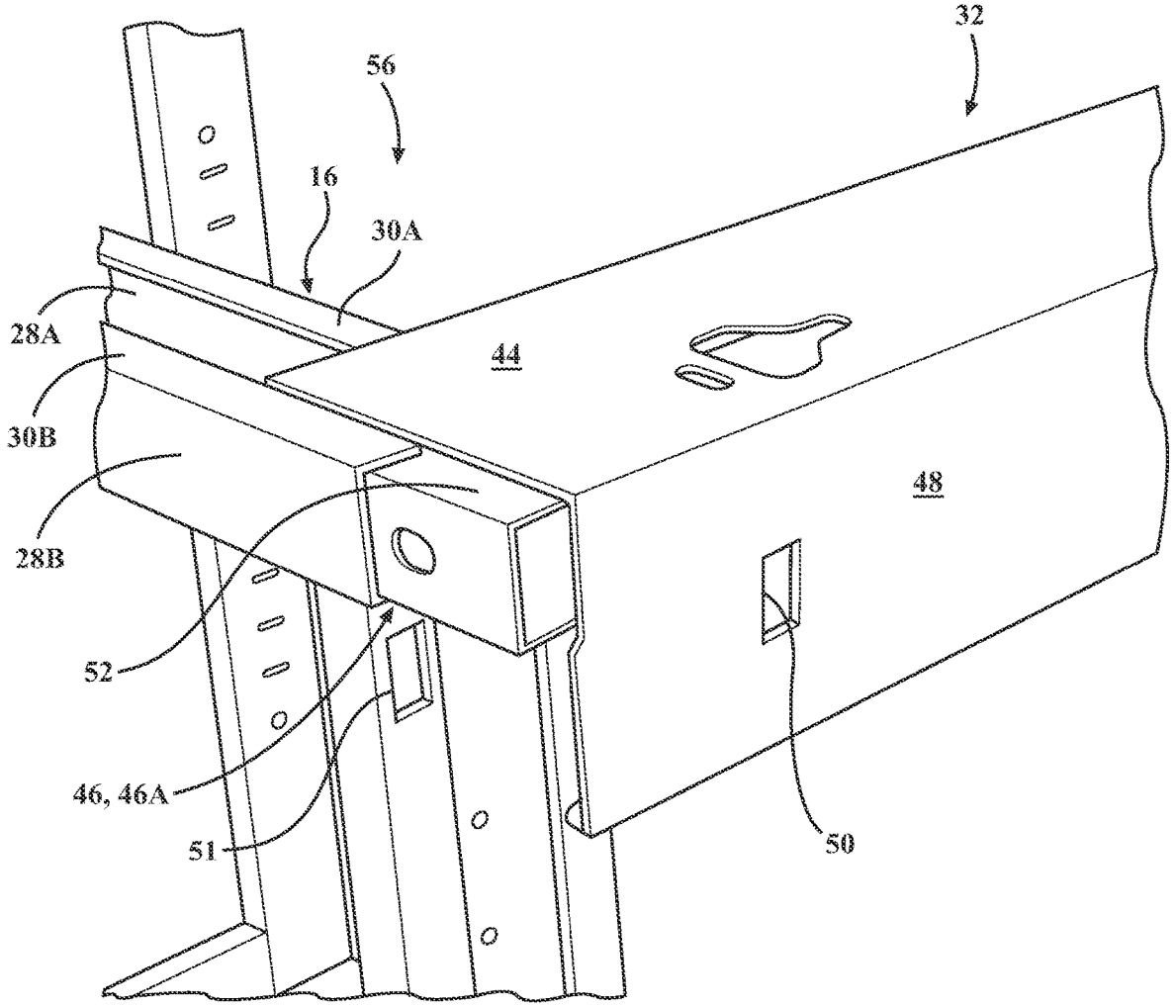
FIG. 6 is an enlarged view of a portion of the interlocking mechanism of FIG. 5B.

Referring to FIGS. 5A-6, the beam 32 further includes an exterior side 48 extending between the top and bottom sides 44, 42. The exterior side 48 may face away from the interior volume 14 of the cabinet assembly 10. The exterior side 48 includes at least one opening 50 for mounting components to the beam 32. In some configurations, the top side 44 includes at least one opening for mounting components to the beam 32 from the top side 44.

In some configurations, the first and second frames 16, 18 may include any number of openings for mounting components to the beam 32. For example, the first and second frames 16, 18 may include an opening 51. In such configurations, the openings 50 and 51 may be for mounting components to the cabinet body 12 and any components thereof. Other configurations are contemplated.

Each of the recessed portions 46A, 46B have an upper surface 52 and a lower surface 54 with the upper surface 52 being disposed below the top side 44. The lower surface 54 of each of the pair of opposing recessed portions 46A, 46B is flush with the bottom side 42 of the beam 32. In some configurations, the lower surface 54 of the recessed portions 46A, 46B may also be considered a part of the bottom side 42 of the beam 32. The recessed portions 46A, 46B may include any number of openings 50 for coupling the beam 32 to the first or second frames of the cabinet assembly 10. For example, the lower surface 54 may include two openings. The two openings may be referred to as latches 60, which will be described in further details below. In another example, the lower surface 54 may include slots shaped to receive the first or second frames. It will be appreciated that recessed portion 46 may be considered as both recessed portions 46A, 46B, unless otherwise stated.

In the configurations shown, the upper surface 52 and lower surface 54 of the recessed portions 46A, 46B may extend substantially parallel to each other. In some configurations, the upper surface 52 and lower surface 54 may not extend substantially parallel to each other. The recessed portions 46A, 46B may also include any number of side surfaces. For example, as shown, the recessed portions 46A, 46B include two side surfaces with a first side surface extending between the upper surface 52 and lower surface 54 of the recessed portion 46, forming a C-shape. In the configuration shown, a second side surface of the recessed portion 46 extends from the lower surface 54 and is substantially parallel to the first side surface. It will be appreciated that the side surface(s) may extend in any direction between the lower and upper surfaces of the recessed portion 46.

An example of how a beam 32 interlocks to the first and second frames 16, 18 from a top perspective is shown through FIGS. 5A-5C. In the configurations shown, the cabinet assembly 10 includes an interlocking mechanism 56 to interlock the plurality of beams 32 to each of the first and second frames 16, 18. Put differently, the interlocking mechanism 56 is provided such that the beams interlock to each of the first and second frames 16, 18 within the first and second open channels 22, 24 to connect the first frame 16 to the second frame. The connection between the plurality of beams 32 to each of the first and second frames 16, 18 are accomplished without requiring minimal, if any, tools. Cabinets that can be assembled or disassembled with minimal tools or without the use of tools allows for ease of installation. In this way, the cabinet assembly 10 of the present invention provides a cabinet assembly 10 that is less expensive to manufacture and easier to assemble with the interlocking mechanism 56. Additionally, the cabinet assembly 10 provides an improved functionality and usability and, at the same time, reduces the time and effort required to assemble the cabinet assembly 10.

Figure 8:
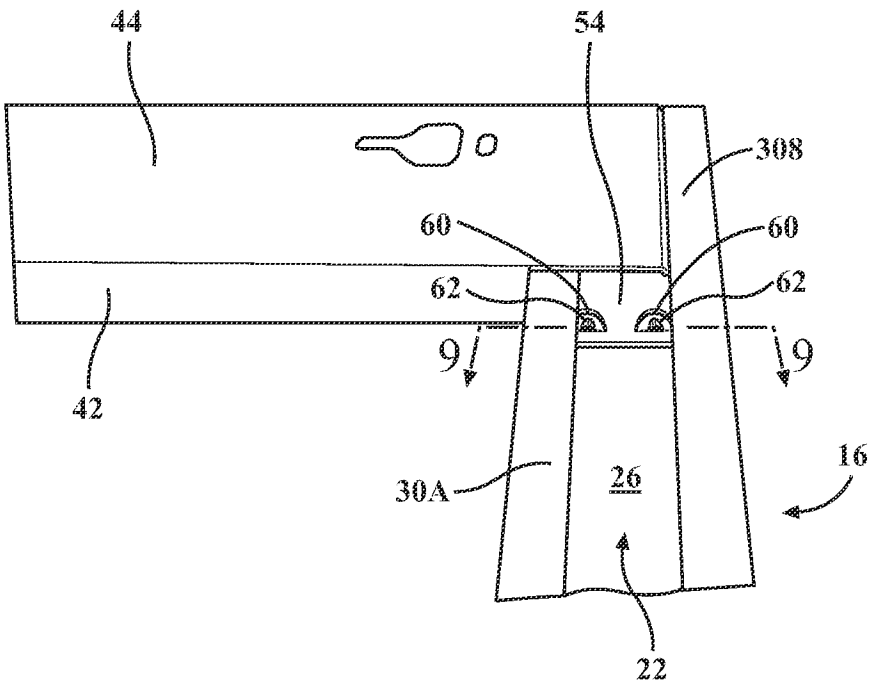
FIG. 8 is the perspective view of FIG. 7, showing the beam interlocked with the first frame of the cabinet assembly.
Figure 7:
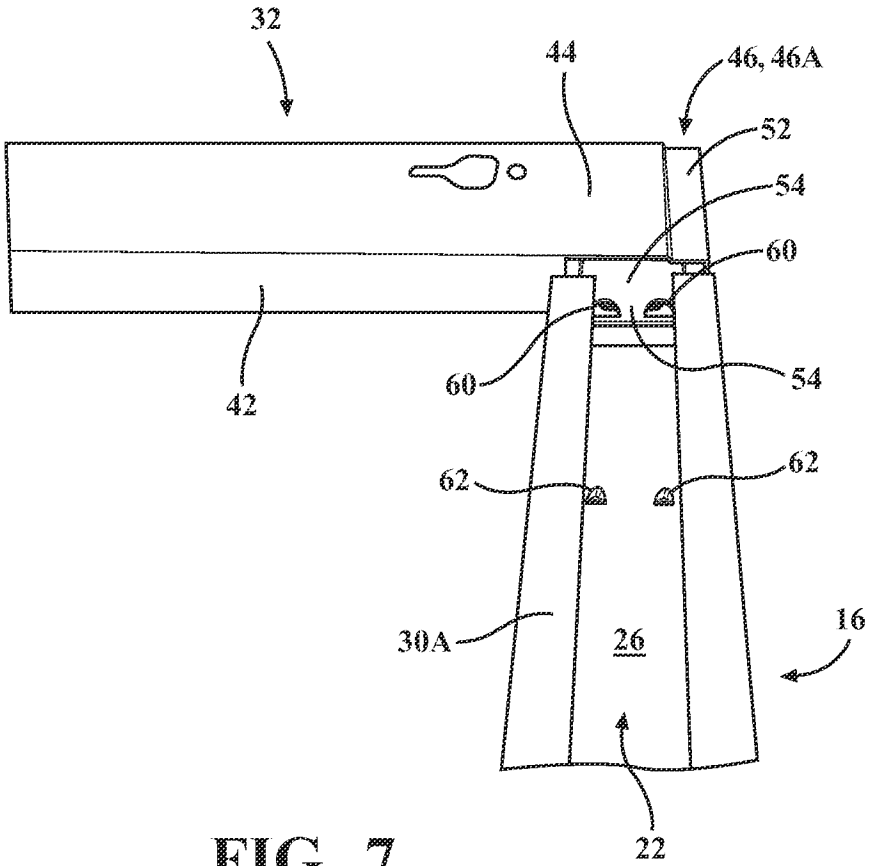
FIG. 7 is a perspective view of a beam including a latch and the first frame including a notch.
Figure 9:
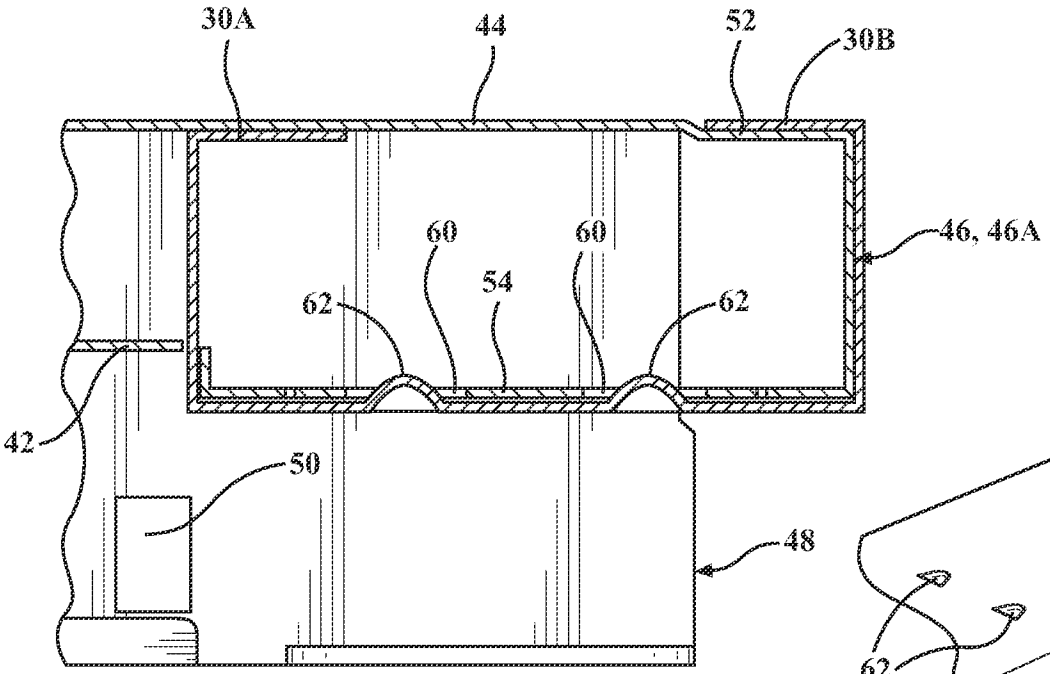
FIG. 9 is a cross-sectional view generally taken through line 9-9 of FIG. 8, showing the beam interlocked with the first frame of the cabinet assembly.

As shown in FIGS. 5A and 7, the beam 32 is aligned with the first and second open channels 22, 24 of the first and second frames 16, 18. Then, as shown in FIGS. 5B and 6 (closer view), the beam 32 is configured to slidably engage the first and second frames 16, 18. Once interlocked, the top side 44 is disposed outside the first open channel 22 to interlock the beam 32 to the first and second frames 16, 18, as shown in FIG. 5C. Referring now to FIGS. 7 and 8, at least one of the upper surfaces 30A, 30B of each of the first and second frames 16, 18 is above the upper surface 52 of each of the recessed portions 46A, 46B when the pair of opposing recessed portions 46A, 46B are disposed within the first and second open channels 22, 24. At least one of the upper surfaces 30A, 30B is flush with the top side 44 of the beam 32 and the other upper surface, different from the upper surface flushed with the top side 44, of the first or second frame 18, 18 is below the top side 33 of the beam 32. More specifically, as shown in FIG. 9, the upper surface 30B of the first frame 16 is flush with the top side 44 of the beam 32. The other upper surface 30A of the first frame 16 is below the top side 44 of the beam 32. In this configuration, the beam 32 and first and second frames 16, 18 are interlocked at each of the beams 32. The interlocking mechanism 56 between the beam 32 and the first and second frames 16, 18 ensures the connection between the beam(s) and the first and second frames 16, 18. The connection relies on the friction and/or mechanical interlock between at least one upper surface 30A, 30B of the first and second open channels 22, 24 and the top side 44 of the beam 32 and between the other upper surface 30A, 30B of the first and second open channels 22, 24 and the upper surface 52 of the recessed portions 46A, 46B.

Figure 10:
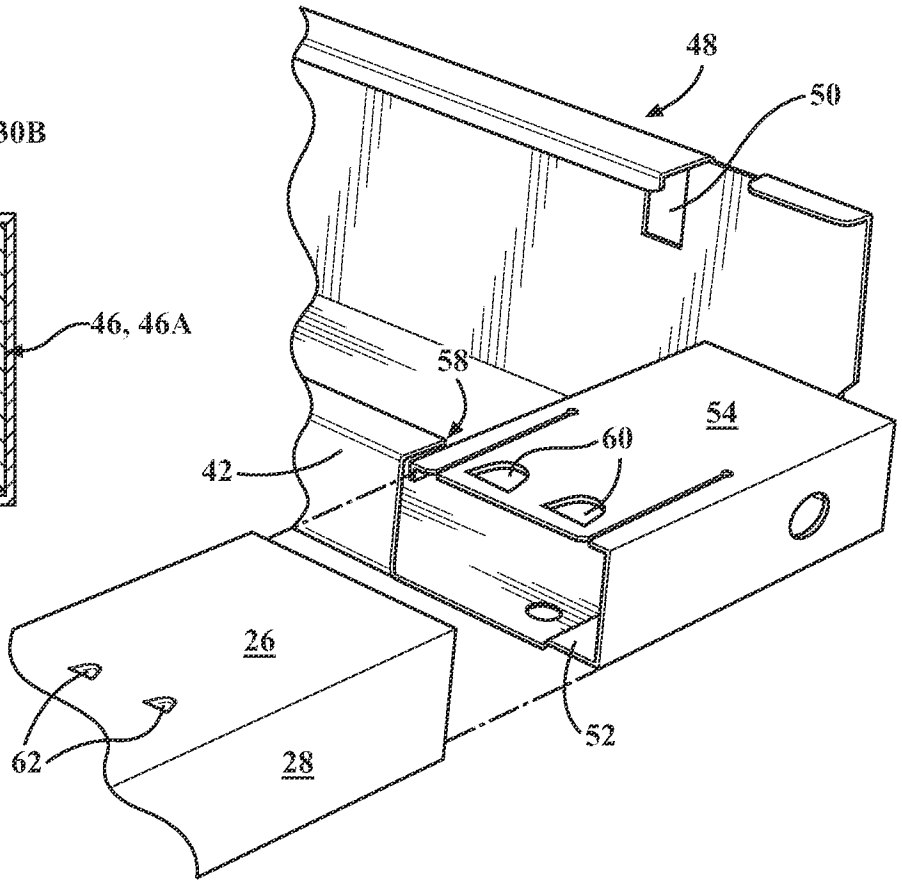
FIG. 10 is a partial bottom perspective view of the beam and the first frame with the notch receiving the beam when the beam interlocks to the first frame.

Further, a portion of the bottom side 42 and the entire recessed portion 46 is disposed with the first open channel 22 and the second open channel. As shown in FIGS. 9 and 10, the bottom side 42 of the beam 32 includes a slot 58 for receiving at least one side surface of the first and second open channel. The lower surface 54 of the recessed portions 46A, 46B is spaced from the bottom side 42 to define the slot 58 between the lower surface 54 of the recessed portions 46A, 46B and the bottom side 42 of the beam 32. The lower surface 54 of each of the pair of opposing recessed portions 46A, 46B is flush with the bottom side 42 of the beam 32. In some configurations, the lower surface 54 of the recessed portion 46 may be considered the bottom side 42 of the beam 32.

Referring to FIGS. 7 and 8 and illustrated in FIG. 9, in one configuration, the interlocking mechanism 56 is further defined as at least one latch 60 and at least one notch. As mentioned above, the first and second frames 16, 18 includes the lower surface 26. The lower surface 26 further includes at least one notch. The bottom side 42 of the beam 32 includes at least one latch 60 configured to couple to at least one notch 62 of the lower surface 26 of the first and second open channels 22, 24 of the first and second frames 16, 18. FIGS. 7 and 8 are an exemplary illustration of the beam 32 including the latch 60 and the lower surface 26 including the notch 62 with the latch 60 and notch 62 coupling and the beam 32 interlocking with the first frame 16. In configurations wherein the bottom side 42 of the beam 32 and the lower surface 54 of the recessed portions 46A, 46B are separate components, the lower surface 54 of the recessed portion 46 may also include at least one latch 60. In other configurations wherein the bottom side 42 of the beam 32 and the lower surface 54 of the recessed portion 46 are considered the same, the bottom side 42 of the beam 32 may include at least one latch 60. Alternatively, any surfaces of the first frame 16, the second frame, the bottom side 42 of the beam 32, and/or the recessed portion 46 may include the notch 62 and/or latch 60. In the configurations shown, the interlocking mechanism 56 includes two latches 60 and two notches 62. In other configurations, the interlocking mechanism 56 may include any number of latches 60 and/or notches 62.

The latch 60 of any suitable configuration is provided on the lower surface 54 of the recessed portion 46 and configured to contact the notch. In some configurations, the latch 60 is configured to snap fit with the notch. The notch 62 is configured to receive the beam 32 when the beam 32 interlocks to each of the first and second frames 16, 18 and the latch 60 is sized to engage the notch. The notch 62 is configured to be located on the lower surface 26 of the first and second open channels 22, 24 at a length substantially similar to the length of the bottom side 42 of the beam 32 and/or the lower surface 54 of the recessed portion 46. It will be appreciated that the notch 62 may be any type of position locator including, but not limited to, a groove, detent, threaded member, or other mechanical interface.

In other configurations, the cabinet assembly 10 may include any other type of interlocking mechanism 56. For example, the interlocking mechanism 56 may be a keyed connection including a tongue-style connector. The beam 32 may fit to the first and second frames 16, 18 via a leading edge of sliding, hinged, or lift-off guards to provide the interlock. In another example, the interlocking mechanism 56 may be a hinged connection wherein the beam 32 may couple to the first and second frames 16, 18 via a pin. In yet another example, the interlocking mechanism 56 may include any type of interlocking feature through snap fit, press fit, interference fit, or frictional fitting such that the beam 32 engages with the first and second frames 16, 18.

Figure 11:
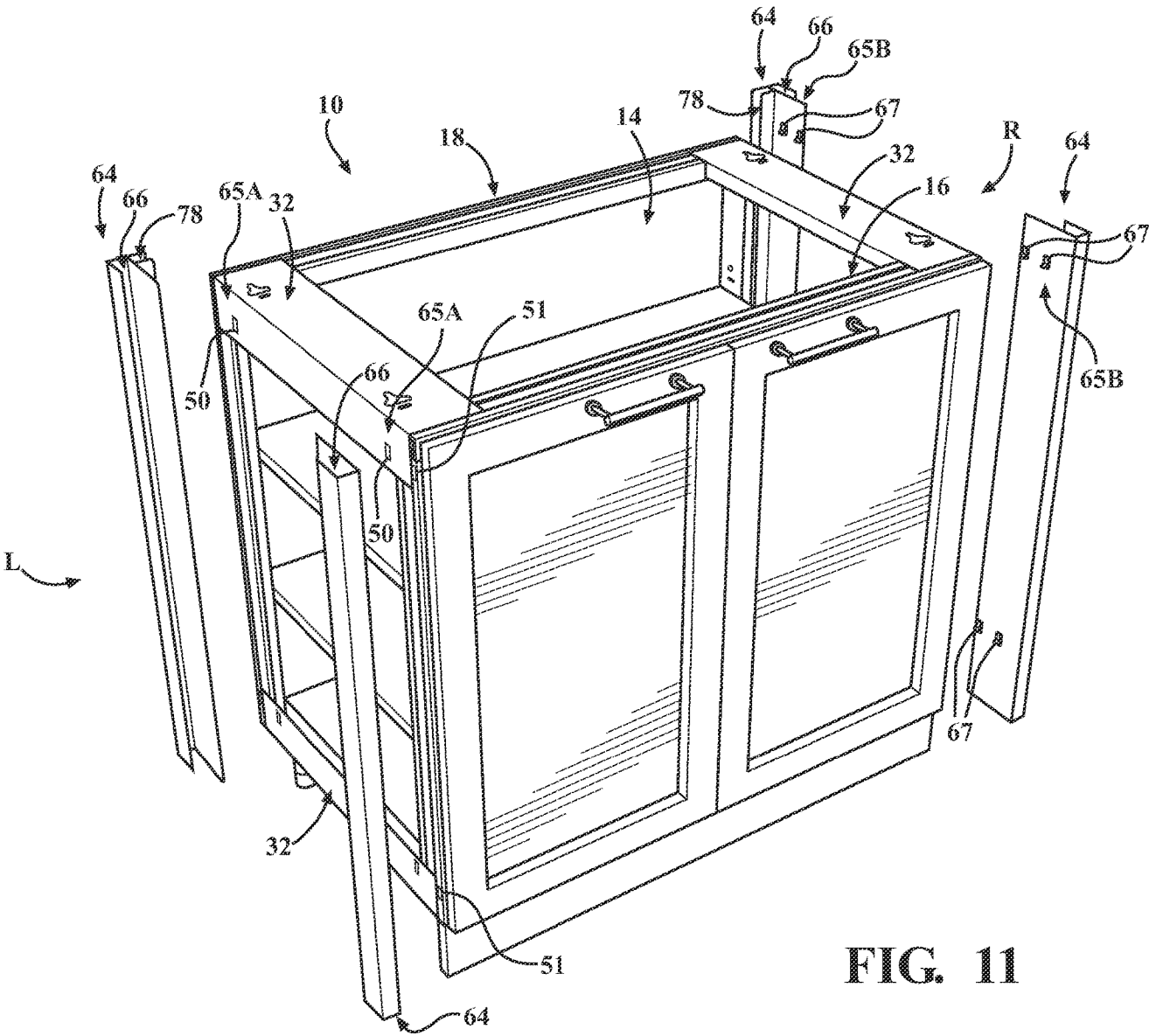
FIG. 11 is a partially exploded, perspective view of the cabinet assembly including a plurality of support brackets.

Referring now to FIG. 11, a partially exploded, perspective view of the cabinet assembly 10 including a plurality of support brackets 64 is shown, according to one configuration. In the configuration shown, the cabinet assembly 10 includes four support brackets 64. In some configurations, the plurality of support brackets 64 may be further defined as a pair of support brackets 64 coupled to each of the left and right sides of the first and second side frames 16, 18. In other configurations, the plurality of support brackets 64 may be further defined as two left side beams and two right side beams being mounted to the left and right sides of the first and second side frames 16, 18, respectively. It will be appreciated that the first and second side frames 16, 18 may be considered as sides of the first and second frames 16, 18 or additional frames to the first and second frames 16, 18.

Figure 12:
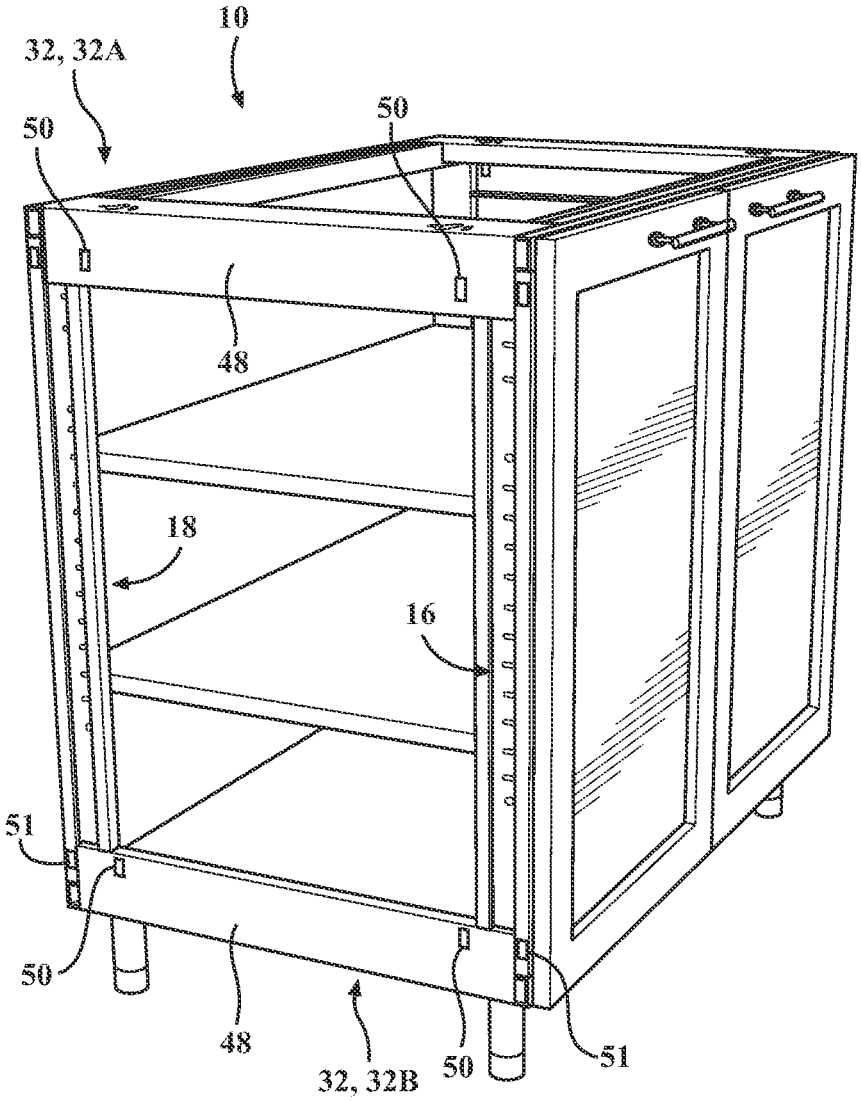
FIG. 12 is a left-side perspective view of the cabinet assembly.
Figure 13:
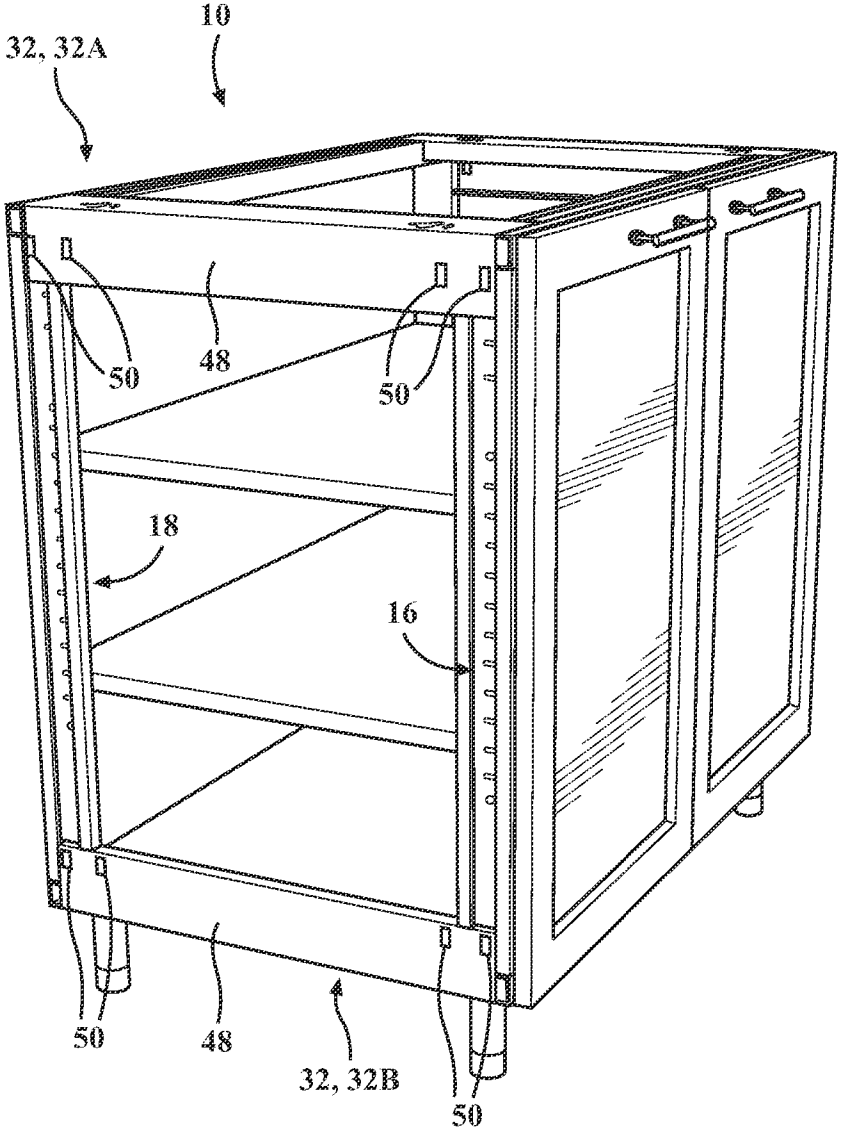
FIG. 13 is a left-side perspective view of the cabinet assembly, according to another configuration.

It is contemplated that the exterior side 48 may include any number of openings 50. For example, shown in FIG. 13, the beam 32 may include the exterior side 48 extending between the top and bottom sides 44, 42 wherein the exterior side 48 includes two openings 50 for mounting components to the beam 32. In another example, as shown in FIG. 12, the exterior side 48 includes one opening 50 for mounting components to the beam 32. It is further contemplated that the first and/or second frames may include any number of openings for mounting components. For example, as shown throughout the Figures, the first and second frames 16, 18 each include two openings 51. In another example, the first and second frames 16, 18 may each include one opening. In yet another example, the first frame 16 may include one opening and the second frame 16 may include two openings. Other configurations are contemplated.

Figure 14:
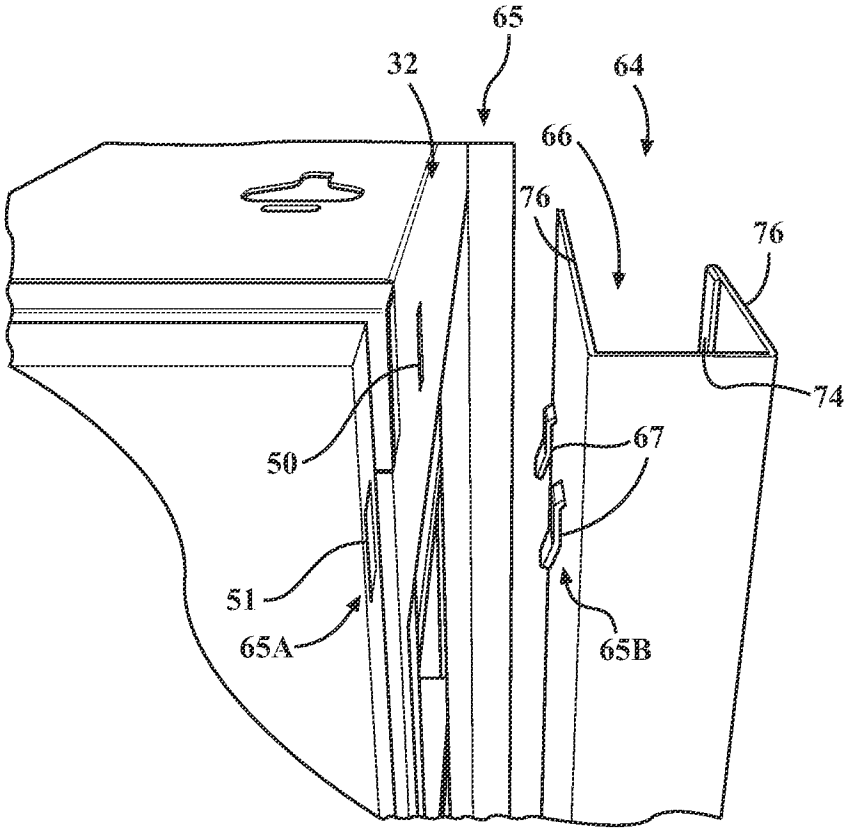
FIG. 14 is an enlarged view of the support bracket defining at least one track and at least one latch extending outwardly from the track.

Referring now to FIG. 14, the cabinet assembly 10 further includes a mounting mechanism 65. The mounting mechanism 65 includes a first portion 65A on at least one of the plurality of beams and a second portion 65B on at least one of the plurality of support brackets to mount the support bracket to the beam, according to one configuration. In other configurations, the first and second portions 65A, 65B may be on any component. For example, the first portion 65A may be on at least one of the plurality of support brackets and the second portion 65B may be on at least one of the plurality of beams. It will be appreciated that any component of the cabinet assembly may include the mounting mechanism.

The plurality of support brackets 64 each define at least one track 66 and at least one latch 67 extending outwardly from the track 66. At least one latch 67 is configured to extend through at least one opening 50 in one of the beams 32A, 32B, 32C, 32D, the first frame 16, and/or the second frame to mount the support bracket 64 to the beams 32A, 32B, 32C, 32D, the first frame 16, and/or the second frame 18. At least one latch 67 may be configured to extend through the opening 51 of the first frame 16 or the second frame 18 to mount the support bracket 64 to the beams 32A, 32B, 32C, 32D, the first frame 16, and/or the second frame 18. In the configuration shown in FIG. 14, the support bracket includes four latches 67 extending outwardly from the track 66 and each beam 32 include one opening and the first and second frames 16, 18 each include at least one opening. The four latches 67 are configured to extend through the opening 50 of the exterior side 48 of the beam 32 and opening 51 to mount the support bracket 64 to the beam. In other configurations, the support brackets 64 may include any number of latches 67. In the configurations shown, the latches 67 are located at the top and bottom ends of the track 66. It will be appreciated that the latch(es) 67 may be positioned at any location along the track 66 to mount the support bracket 64 to the cabinet assembly 10.

As shown, the first portion 65A of the mounting mechanism 65 may further be defined as the opening 50 on the exterior side 48 of one of the beams 32. Further, the second portion 65B of the mounting mechanism 65 may further be defined as the one latch 67, wherein the latch 67 extends through the opening 50 in one of the beams 32 to mount the support bracket 64 to the beam 32. It is contemplated that the first portion 65A and the second portion 65B may be the alternate.

In other configurations, the first portion 65A of the mounting mechanism 65 may further be defined as the opening 50 on the exterior side 48 of one of the beams 32 and the opening 51 of the first frame 16 and/or the second frame 18. In such configurations, the second portion 65B of the mounting mechanism 65 may further be defined as the two latches 67, wherein the latches 67 extends through the opening 50 and opening 51 to mount the support bracket 64 to the beam 32, the first frame 16, the second frame 16, and any combinations thereof. Similar to above, it is contemplated that the first and second portions 65A, 65B may be the alternate.

Figure 15:
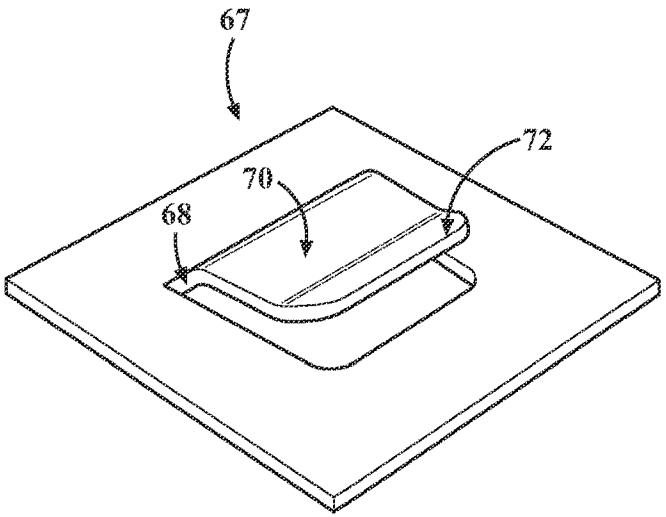
FIG. 15 is a perspective view of the latch, according to one configuration.

In some configurations, as shown in FIG. 14, the latch 67 may be integral with the track 66. In some configurations, as shown in FIG. 15, the latch 67 may be a separate component configured to attach to the track 66. In such configurations, the latch 67 may be secured to the track 66 with one or more fasteners, adhered to the track 66, or the like. It will be appreciated that the latch 67 may be configured to couple to the track 66 in any suitable manner.

The latch 67 may be formed to extend away from the track 66 to allow mounting of the track 66 to the beam, the first frame 16, the second frame, and/or any component of the cabinet assembly 10. As shown in FIGS. 14 and 15, the at least one latch 67 includes a first portion 68 extending away from the track 66, a second portion 70 extending substantially parallel to a side surface of the track 66, and a third portion 72 extending away from the track 66. The latch 67 may extend through the opening 50 of the exterior side 48 of the at least one plurality of beams 32 such that the side surface of the track 66 abuts the exterior side 48 of the at least one of said plurality of beams 32. For example, the second portion 70 of the latch 67 may extend through the opening 50 of the exterior side 48 of the beam 32 such that the side surface abuts the exterior side 48 of the beam 32. In another example, any portion of the latch 67 may extend through the opening 50 of the exterior side 48 while at the same time any number of portions may not extend through the opening. In configurations with more than one latch 67, at least one latch 67 may extend through the opening 50 of the exterior side 48 of the at least one plurality of beams 32 and another latch 67 may extend through the opening 51 of the first or second frames 16, 18. In such configurations, similar to above, the section portion 70 of the latches 67 may extend through the openings 50, 51 such that the side surface of the track 66 abuts the exterior side 48 of the beam 32.

In the configurations shown, the latch 67 includes portions forming a substantially S-shape. In other configurations, the latch 67 may include portions forming a zig-zag shape. It will be understood that the latch 67 may include any number of portions forming any shape. For example, the latch 67 may include a portion forming a shape to match or fit the opening 50 of the beam 32. In such configurations, the latch 67 is adapted to be inserted into the opening 50 of the beam 32 to mount the support bracket 64 to the beam 32.

Alternatively, or additionally, in some configurations, the plurality of support brackets 64 may include an opening sized to receive a latch 67 or mating component of the beam 32, the first frame 16, the second frame, and/or any component of the cabinet assembly 10 to mount the support bracket(s) to the beam, the first frame 16, and/or the second frame. In such configurations, the latch 67 or mating component may be similar to the latch 67 described above.

Figure 16:
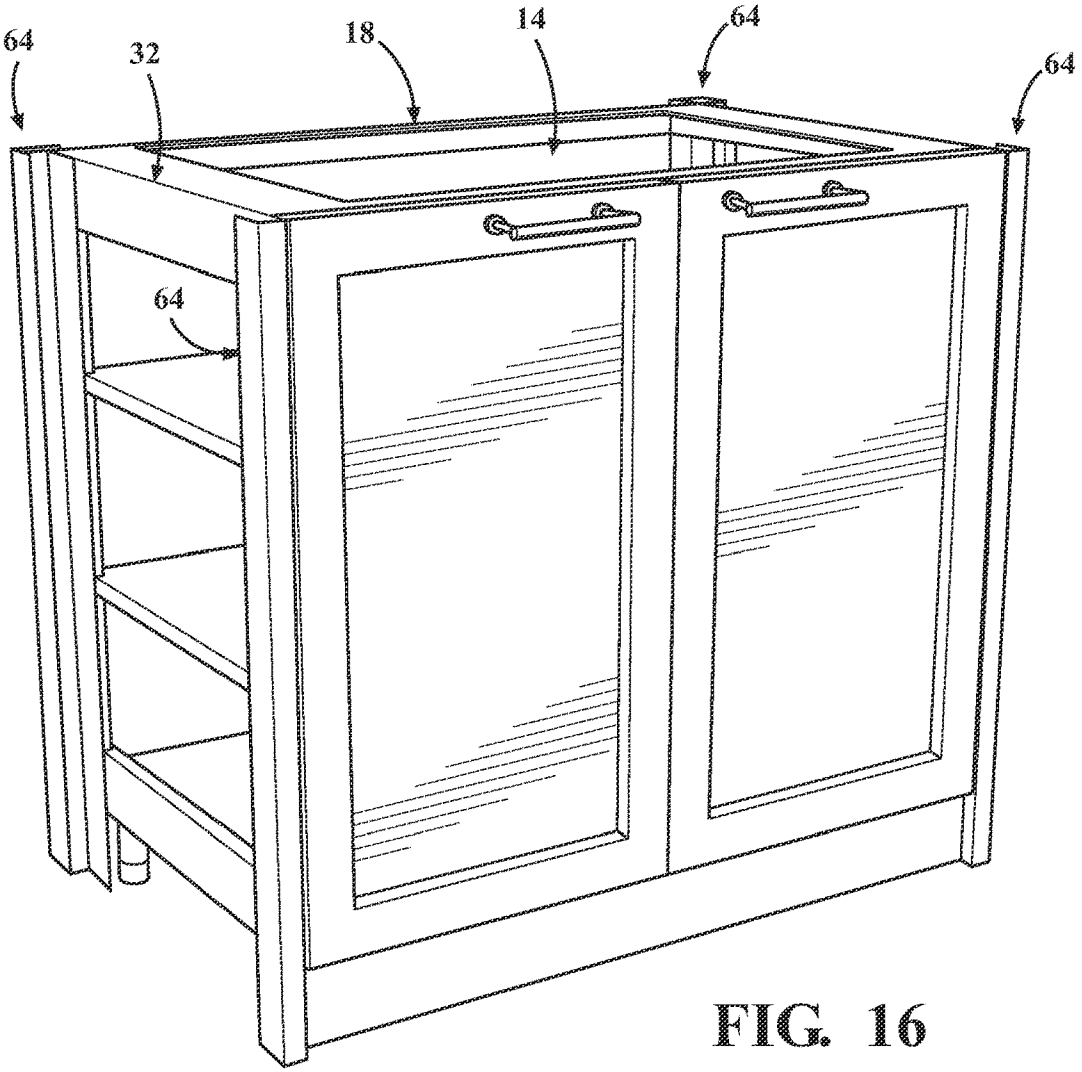
FIG. 16 is a perspective view of the cabinet assembly illustrating the track of the support bracket mounted to at least one beam.

At least one track 66 is configured to oppose another track 66 of a support bracket 64. For example, as shown in FIG. 16, a pair of support brackets 64 are coupled to each of the left and right sides of the first and second side frames or first and second frames 16, 18 and the tracks 66 of the pair of support brackets 64 on each side are opposing each other. In other words, the track 66 of support bracket is opposing the track 66 of another support bracket.

Referring to FIG. 16 and referencing FIG. 11, the track 66 includes a back surface 74 and a pair of parallel side surfaces 76 extending from the back surface 74 from opposite ends of the back surface 74. The back surface 74 and pair of parallel side surfaces 76 define a substantially C-shaped configured, best shown in FIG. 11. One of the pair of parallel side surfaces 76 is longer than the other parallel side surface. In such configurations, the at least one latch 67 extends from the longer of the pair of parallel side surfaces 76. Further, the at least one latch 67 includes a portion extending away from the longer of the pair of parallel side surfaces 76. In other configurations, the at least one latch 67 may include a portion extending away from the shorter of the pair of parallel side surfaces 76. It will be appreciated that the pair of parallel sides surfaces may extend the same length.

In some configurations, the plurality of support brackets 64 may each further define a second track 78. In such configurations, as best shown in FIG. 11, a portion of the back surface 74 of the track 66 may extend beyond at least one of the side surfaces. The support brackets 64 may further include a side surface, parallel to the portion of the back surface 74 that extends beyond the at least one of the side surfaces. In such a configuration, the second track 78 of a support bracket may be opposing to the second track 78 of another support bracket when mounted to the cabinet assembly 10. It will be appreciated that the support brackets 64 may define any number of tracks 66. It is contemplated that the tracks 66, 78 may be a continuous track with no interruptions or discontinuities or a discontinuous with interruptions or discontinuities.

Figure 17B:
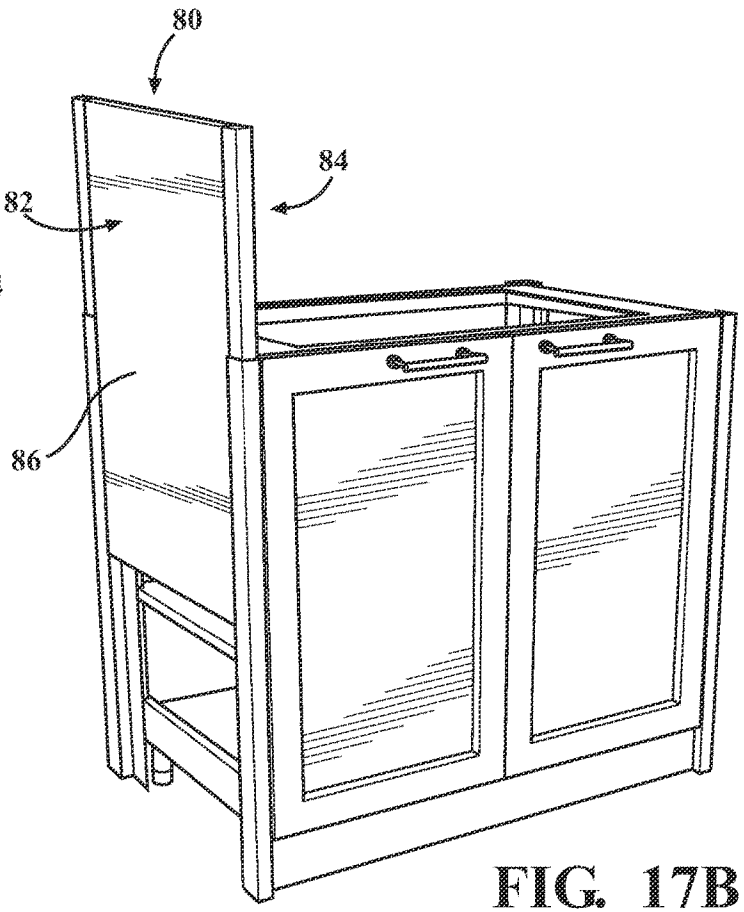
FIG. 17A-17B is a perspective view of the cabinet assembly of FIG. 16, shown with a wall panel slidably engaging within the tracks of an opposing pair of support brackets.
Figure 17A:
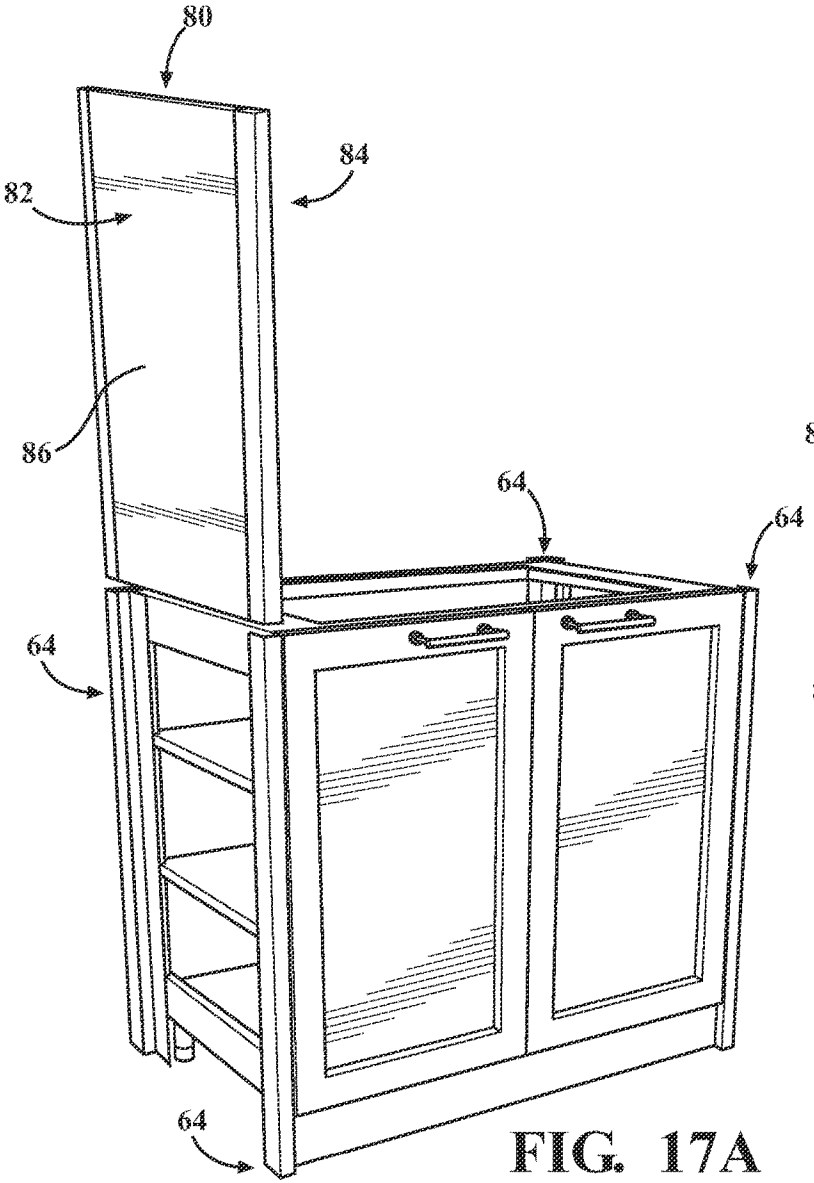
Figure 18B:
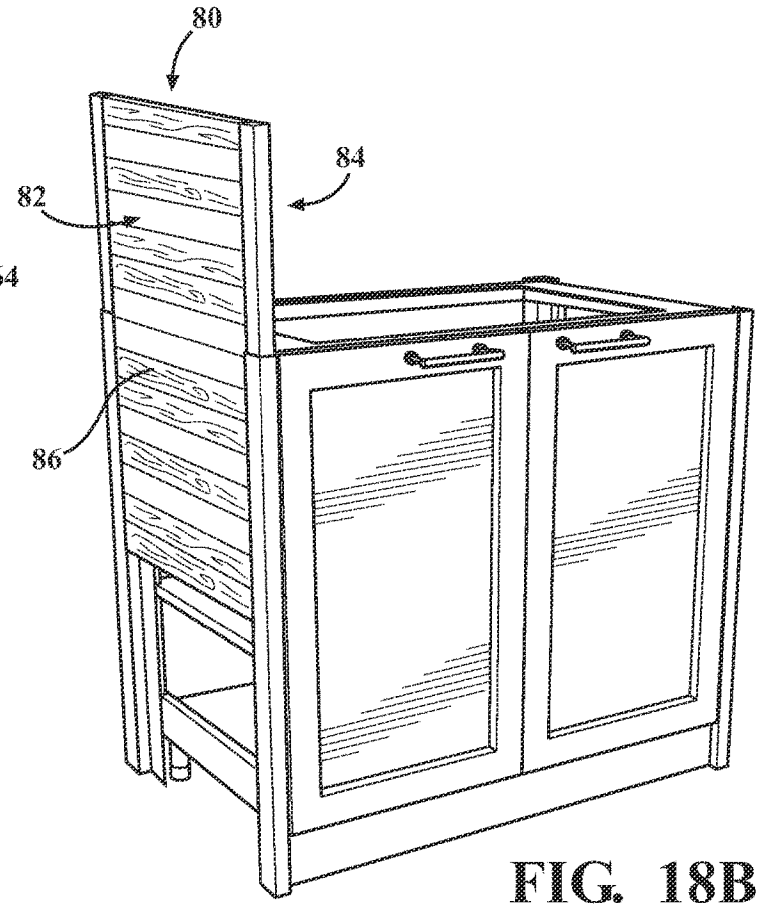
FIGS. 18A-19B is a perspective view of the cabinet assembly of FIGS. 17A-17B, shown with different types of decorative wall panels.
Figure 18A:
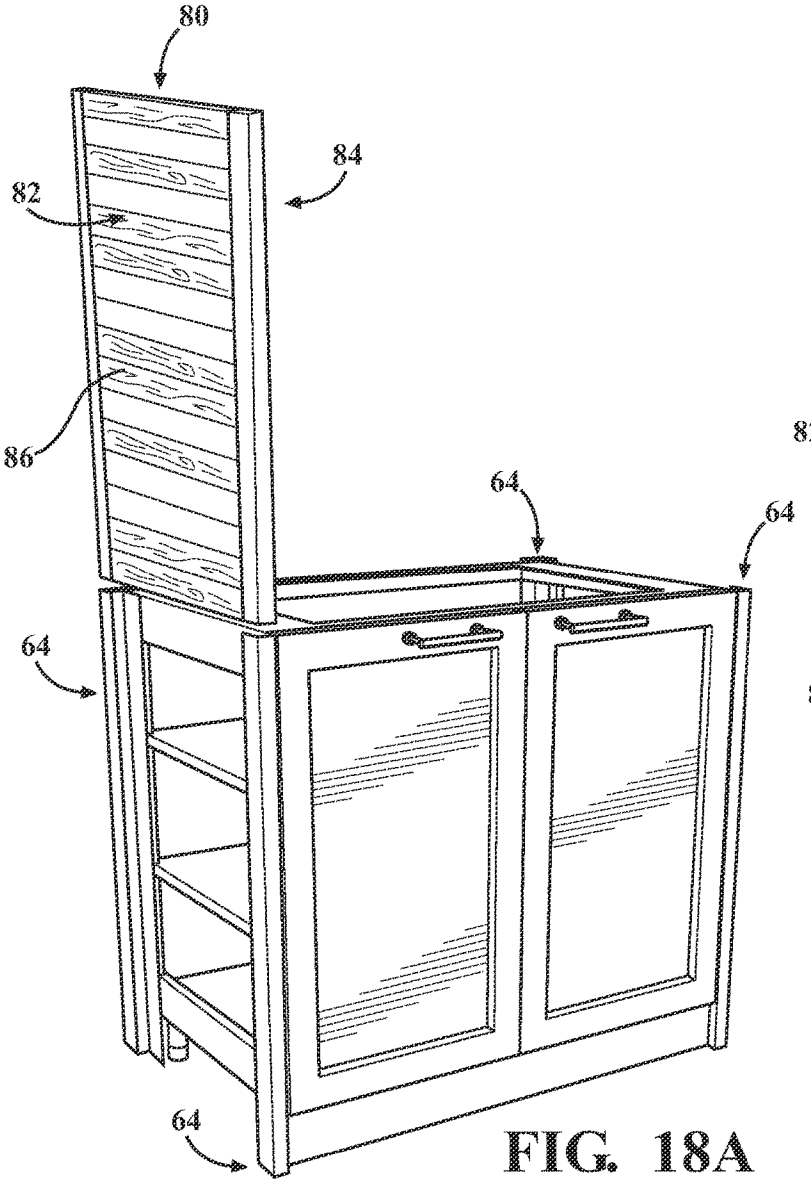
Figure 19B:
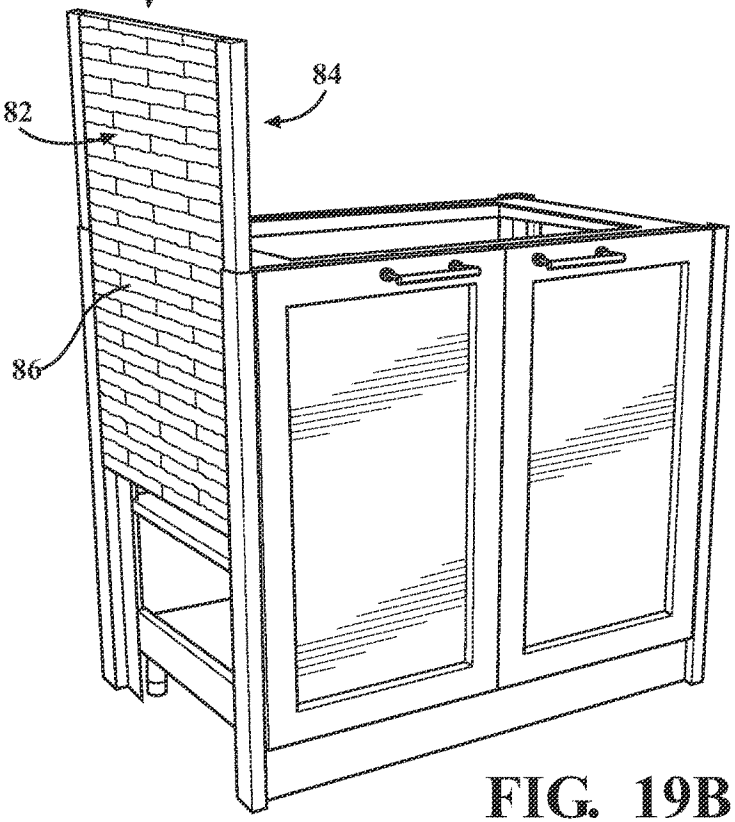
Figure 19A:
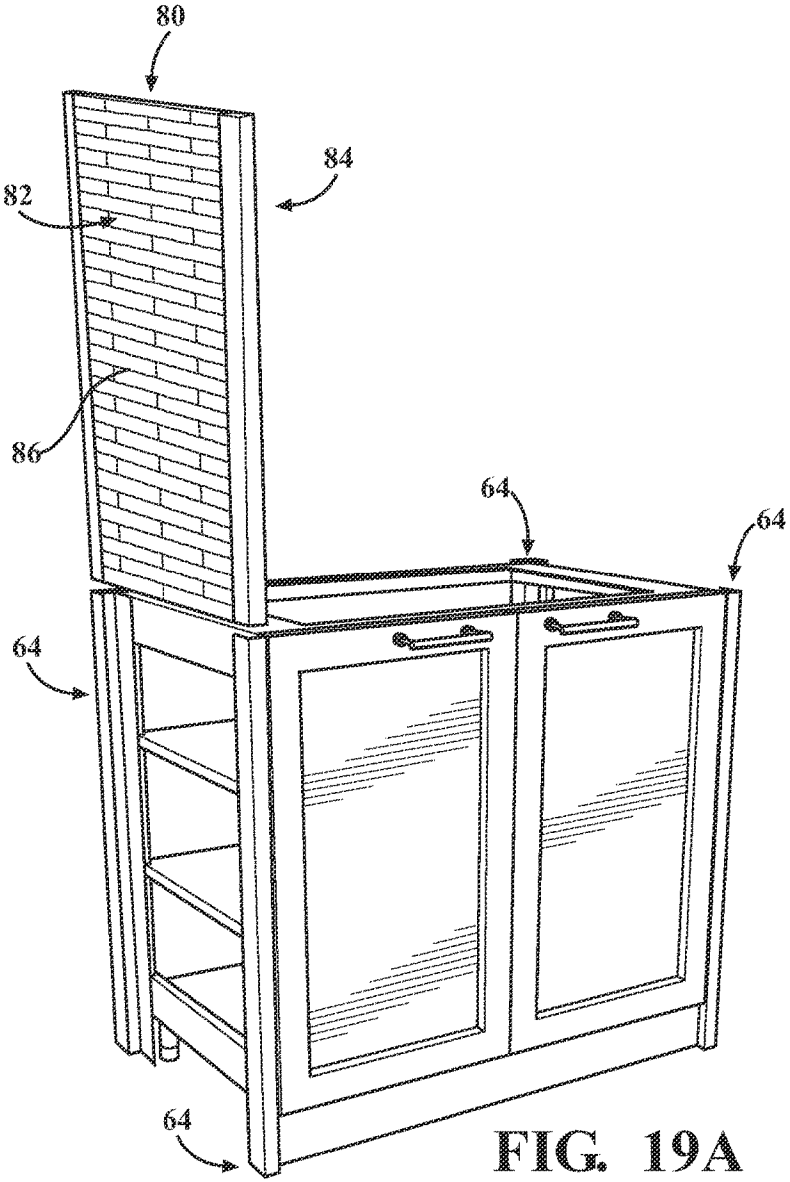

Referring now to FIGS. 17A and 17B, the cabinet assembly 10 further includes a plurality of wall panels 80. Each wall panel is slidably engaged within the tracks 66 of opposing support brackets 64 to define a side S of the cabinet assembly 10. The ease of installation and uninstallation of the wall panels 80 provide for an easy-to-change decor of the cabinet assembly 10 to fit the desired themes or finish preferences of consumers. For instance, for special events or parties, consumers may want to employ a desired color scheme to match the event or party. The consumers may simply slide out a wall panel and switch to a desired decorative wall panel that has a factory-finished look to match the desired color scheme. In another instance, consumers may want to change the look of their cabinets depending on the seasons. The interchangeability, customization, and versatility of the wall panels 80 offer the ability for modifications in appearance and/or aesthetic following installation without the need of buying whole new cabinet assemblies.

As shown, the wall panel is slidably engaged within the tracks 66 of an opposing pair of support brackets 64, defining the left side L of the cabinet assembly 10. It will be appreciated that the wall panel(s) may define any side of the cabinet assembly 10, including the back, front, right, left, top or bottom sides of the cabinet assembly 10. The plurality of beams 32, first frame 16, second frame, and plurality of wall panels 80 may define the interior volume 14 of the cabinet assembly 10. In configurations where one or more cabinet assembly 10 are attached, the plurality of wall panels 80 may define any side of the cabinet assemblies such that the cabinet assembly 10 includes a continuous interior volume 14 between the cabinet assemblies.

The plurality of wall panels 80 each include a front side 82 and back side 84. The front side 82 further includes a decorative layer 86, as illustrated through FIGS. 18A-19B. The plurality of wall panels 80 slidably engages within the tracks 66 of the opposing pair of support brackets 64 such that the decorative layer 86 of the front side 82 is configured to face towards an exterior of the cabinet assembly 10. The back side 84 of the wall panel(s) are configured to face towards the interior of the cabinet assembly 10. The decorative layer 86 may be selected from the group consisting of wood, wood-based material, fiber material, plastic, glass, stone, ceramic, mineral material or mixtures thereof. It is appreciated that the term stone and ceramic materials may include material such as, but not limited to, granite, marble, sandstone, slate, tile, porcelain stoneware tiles and the like.

The decorative layer 86 of the wall panels 80 may be secured to the front side 82 of the wall panels 80 in any suitable manner including, but not limited to, adhesion, fastening, stapling, spraying, coating, and the like. In other configurations, the decorative layer 86 may be integrated with the front side 82 of the wall panels 80 such that the decorative layer 86 and the front side 82 are one integral component. It is contemplated that the decorative layer 86 may couple to any panel of the cabinet assembly 10.

The interchangeability and/or customizability of the wall panels 80 provide for more of an aesthetically pleasing design for the cabinet assembly 10, as shown through FIGS. 18A-19B. The decorative layer 86 of the wall panels 80 may comprise any type of material including, but not limited to, wood, metal, vinyl, foam, natural material, or the like. Further, the decorative layer 86 may be coated, painted, sprayed, stained, or the like to produce any type of pattern. For example, a painted pattern of brick may be the most aesthetically pleasing of the material to the consumer. In another example, a wood grain appearance may be the most aesthetically pleasing of the material to the consumer. In yet another example, the decorative layer 86 may include any type of finish material including, but not limited to, tile, stainless steel (including textured stainless steel), solid surface, marble, granite, quartz-based stone, glass, frosted glass, and other such comparable materials utilized in cabinet applications.

The cabinet assembly 10 may further include an adjustable mechanism to adjust the height, width, or length of the cabinet assembly 10 as a whole and/or the adjustable mechanism may be configured to adjust a height and/or width of any component of the cabinet assembly 10, including, but not limited to, the first frame 16, the second frame, and/or the plurality of beams 32. For instance, the adjustable mechanism may adjust the height of the cabinet assembly 10. In such configurations, the adjustable mechanism may include at least one height-adjustable component that is selectively raised into an upper position or lowered into a lower position. The height-adjustable component may be secured within the cabinet assembly 10. In other configurations, the height-adjustable component may be attached to a bottom of the cabinet assembly 10. In another example, the adjustable mechanism may adjust the width the cabinet assembly 10. In such configurations, the adjustable mechanism may include at least one width-adjustable component that is selectively widen into a wider position or narrowed into a narrower position. The width-adjustable component may be secured within the cabinet assembly 10. In other configurations, the width-adjustable component may be attached to or integrated with the frames of the cabinet assembly 10. It will be appreciated that the adjustable mechanism may adjust any component and/or feature of the cabinet assembly 10.

The invention has been described in an illustrative manner, and it is be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

Several configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A cabinet assembly including:

a first frame having a first open channel;

a second frame spaced from the first frame with the second frame having a second open channel; and a plurality of beams extending between the first frame and the second frame and interlocking to each of the first and second frames within the first and second open channels to connect the first frame to the second frame, each of the plurality of beams including:

a bottom side;

a top side opposite the bottom side; and a pair of opposing recessed portions extending from the top side to the bottom side, each of the recessed portions having an upper surface and a lower surface with the upper surface being disposed below the top side;

wherein a portion of the bottom side and the entire recessed portion extending from the top side to the bottom side is disposed within the first open channel; and wherein the top side is disposed outside the first open channel to interlock the beam to the first and second frames.

2. The cabinet assembly of claim 1, wherein each of the first and second frames include a right side and a left side, and the plurality of beams being further defined as two left side beams being mounted to the left side of each of the first and second frames and two right side beams being mounted to the right side of each of the first and second frames.

3. The cabinet assembly of claim 1, wherein each of the first and second frames include a lower surface, a pair of side surfaces, and a pair of upper surfaces and with at least a portion of the pair of upper surfaces defining a top opening to partially define the first and second open channels.

4. The cabinet assembly of claim 3, wherein the lower surface, pair of side surfaces, and pair of upper surfaces are spaced to define at least one side opening to partially define the first and second open channels.

5. The cabinet assembly of claim 1 further including an interlocking mechanism to interlock the plurality of beams to each of the first and second frames.

6. The cabinet assembly of claim 5, wherein the lower surface includes the interlocking mechanism further defined as at least one notch receiving the beam when the beam interlocks to each of the first and second frames.

7. The cabinet assembly of claim 6, wherein the bottom side of the beam includes at least one latch configured to couple to the at least one notch of the lower surface.

8. The cabinet assembly of cl aim 6, wherein the at least one notch is configured to be located on the lower surface of the first or second open channel at a length substantially similar to the length of the bottom side of the beam.

9. The cabinet assembly of claim 3, wherein the bottom side of the beam includes a slot for receiving at least one side surface of the first or second open channel.

10. The cabinet assembly of claim 3, wherein the upper surface of the first and second frames is above the upper surface of each of the recessed portions when the pair of opposing recessed portions are disposed within the first and second open channels.

11. The cabinet assembly of claim 3, wherein the upper surface of the first and second frames is flush with the top side of the beam.

12. The cabinet assembly of claim 1, wherein the lower surface of each of the pair of opposing recessed portions is flush with the bottom side of the beam.

13. The cabinet assembly of claim 1, further including at least one exterior panel coupled to at least one of the first frame and the second frame.

14. A cabinet assembly including:

a first side frame and an opposing second side frame;

a bottom panel coupled to the first frame and second frame;

a plurality of beams extending between the first side frame and the second side frame and interlocking to each of the first and second side frames to connect the first side frame to the second side frame and to define an interior volume of the cabinet assembly;

a plurality of support brackets with each support bracket defining at least one track;

a mounting mechanism including a first portion on at least of one of the plurality of beams and a second portion on at least of one of the plurality support brackets to mount the support bracket to the beam; and a plurality of wall panels with each wall panel slidably engaged within the at least one track of each of an opposing pair of support brackets for defining a side of the cabinet assembly.

15. The cabinet assembly of claim 14, wherein each of the first and second side frames include a right side and a left side, and the plurality of beams being further defined as two left side beams and two right side beams being mounted to the left and right sides of each of the first and second side frames, respectively.

16. The cabinet assembly of claim 14, wherein the plurality of support brackets being further defined as a pair of support brackets coupled to each of the left and right sides of the first and second side frames with the tracks opposing each other to support one of the plurality of wall panels.

17. The cabinet assembly of claim 14, wherein the plurality of wall panels include a front side and a back side with the front side including a decorative layer.

18. The cabinet assembly of claim 17, wherein the plurality of wall panels slidably engages within the tracks such that the decorative layer of the front side is configured to face towards an exterior of the cabinet assembly.

19. The cabinet assembly of claim 14, wherein the track includes a back surface and a pair of parallel side surfaces extending from the back surface from opposite ends of the back surface wherein the back surface and pair of parallel side surfaces define a substantially c-shaped configuration.

20. The cabinet assembly of claim 19, wherein one of the pair of parallel side surfaces is longer than the other parallel side surface and the at least one latch extends from the longer of the pair of parallel side surfaces.

21. The cabinet assembly of claim 19, wherein the first portion of the mounting mechanism is further defined as an opening on an exterior side of one of the beams, and the second portion of the mounting mechanism is further defined as at least one latch extending outwardly from the track of one of the support brackets, wherein the at least one latch extends through the opening in one of the beams to mount the support bracket to the beam.

22. The cabinet assembly of claim 21, wherein the at least one latch includes a first portion extending away from the longer of the pair of parallel side surfaces, a second portion extending substantially parallel to the pair of parallel side surfaces, and a third portion extending from the second portion and away from the longer of the pair of parallel side surfaces such that the at least one latch is substantially S-shaped.

23. The cabinet assembly of claim 22, wherein the second portion extends through the opening of the exterior side of the at least one of the plurality of beams such that the side surface abuts the exterior side of the at least one of the plurality of beams.

* * * * *